US006896167B2

(12) United States Patent
Haramiishi

(10) Patent No.: US 6,896,167 B2
(45) Date of Patent: May 24, 2005

(54) DRIVER UNIT AND ELECTRIC STAPLER

(75) Inventor: Kiichi Haramiishi, Tokyo (JP)

(73) Assignee: Max Co., Ltd., Tokyo (JP)

( * ) Notice: Subject to any disclaimer, the term of this patent is extended or adjusted under 35 U.S.C. 154(b) by 0 days.

(21) Appl. No.: 10/486,260

(22) PCT Filed: Aug. 9, 2002

(86) PCT No.: PCT/JP02/08182

§ 371 (c)(1),
(2), (4) Date: Feb. 9, 2004

(87) PCT Pub. No.: WO03/013800

PCT Pub. Date: Feb. 20, 2003

(65) Prior Publication Data

US 2004/0188492 A1 Sep. 30, 2004

(30) Foreign Application Priority Data

Aug. 9, 2001 (JP) ..... 2001-242740
Nov. 30, 2001 (JP) ..... 2001-365736

(51) Int. Cl.[7] ..... B27F 7/17
(52) U.S. Cl. ..... 227/131; 227/136; 227/155
(58) Field of Search ..... 227/131, 120, 227/136, 155, 119

(56) References Cited

U.S. PATENT DOCUMENTS 5,460,314 A * 10/1995 Udagawa ..... 227/155
5,791,543 A * 8/1998 Udagawa et al. ..... 227/4
5,823,415 A * 10/1998 Udagawa et al. ..... 227/120
5,975,396 A * 11/1999 Manabe ..... 227/2
6,050,471 A * 4/2000 Yagi ..... 227/119
6,371,352 B1 * 4/2002 Mochizuki ..... 227/155
6,568,579 B2 * 5/2003 Mochizuki ..... 227/131
6,616,029 B1 * 9/2003 Andersson ..... 227/155
6,626,348 B2 * 9/2003 Kitamura ..... 227/155
6,634,536 B2 * 10/2003 Yoshie ..... 227/131

* cited by examiner

*Primary Examiner*—Scott A. Smith
(74) *Attorney, Agent, or Firm*—Chapman and Cutler LLP

(57) ABSTRACT

A driver unit comprises a fixed frame (12), an inner frame (20), a magazine (40), a cartridge (50), a driver (70) attached movably upwardly and downwardly to the magazine (40) and pivoted on the inner frame (20), and a basing member for biasing downwardly the magazine (40). A staple is driven out through the driver (70) entered in a drive-out part by the inner frame being moved upwardly together with the magazine (40) by the lifting of a clincher part (111) of a clincher unit (100). When the clincher part (111) is lowered, the inner frame (20) and magazine (40) are lowered and returned to an initial position by the biasing member. The magazine 40 is attached rotatably about a shaft 44 on the inner frame 20. The cartridge (50) can be removed from the magazine (40) by rotating the magazine (40) to direct upwardly a back portion of the magazine (40).

5 Claims, 32 Drawing Sheets

DRIVER UNIT AND ELECTRIC STAPLER

FIELD OF THE INVENTION

The present invention relates to an electric stapler in which a driver unit and a clincher unit are separated upwardly and downwardly, and the driver unit for therein,

BACKGROUND ART

Conventionally, there is known an electric stapler in which a driver unit and a clincher unit are upwardly and downwardly. The electric stapler is configured to drive-out a staple by up and down movement of a driver in the driver unit and to clinch legs of the drive-out staple by a clincher in the clincher unit.

Moreover, the driver unit is provided with a drive motor for moving upwardly and downwardly the driver and the clincher unit is provided with a drive motor for operating the clincher.

In this way, because the above two motors are provided, there is a problem that an apparatus becomes large and expensive. Therefore, there is proposed an electric stapler in which one drive motor performs the driving-out of the staple and clinching of the legs of the driven-out staple. The electric stapler has a structure that a clincher part of a clincher unit is configured to move upwardly and downwardly by the drive motor and a staple is adapted to drive-out from a drive unit by the up and down movement of the clincher part. The driver unit comprises a magazine mounted moveably upwardly and downwardly on a fixed frame, a driver mounted movably upwardly and downwardly on the magazine, a cartridge mounted attachably and detachably for housing sheet staples and having a drive-out part from which a sheet staple is driven-out, and a spring for biasing downwardly the magazine and for biasing upwardly the driver relative to the magazine.

The magazine is configured to move upwardly and downwardly by the up and down movement of the clincher part in the clincher unit, and when the magazine is lifted in contact with the clincher unit which has been lifted against a biased force of the spring, the driver becomes to be entered in the drive-out part of the cartridge by being moved downwardly relatively to the magazine. The entrance of the driver in the drive-out part causes the staple to drive-out from the drive-out part. The legs of the driven-out staple are clinched by means of the clincher in the clincher unit and thereafter the clincher unit is lowered. When the clincher unit is lowered, the magazine is lowered to return to an initial position.

In other words, the driver is lifted relatively to the magazine by the biased force of the spring to return to the initial position.

By the way, in the driver unit of the electric stapler, because the driver is lifted relatively to the magazine by the spring, if a jam of the staple is generated, there is a problem that the driver is not removed out of the drive-out part of the cartridge because the biased force of the spring is not sufficiently set and therefore the cartridge is not removed out of the magazine.

As the electric stapler of a upwardly and downwardly separated type, there is also known an electric stapler including a driver unit 1 provided movably upwardly and downwardly on a base plate 3 and a clincher unit 2 provided movably upwardly and downwardly to face the driver unit 1, as shown in FIG. 34 A.

In the electric stapler, in order to match a height position on which papers 4 are mounted with the driver unit 1, a pair of paper reference bases 5 and 5 is provided on the base plate 3 at the opposite sides of the driver unit 1.

To staple the papers 4, the clincher unit 2 is lowered as shown in FIG. 34B and then the driver unit 1 is lowered together with the clincher unit 2 following to the lowering thereof. A driver 8 is lifted relatively to the driver unit 1 by the lowering thereof to drive-out a staple 6. Legs of the drive-out staple 6 are penetrated into the papers 5 and then the penetrated legs are clinched by means of the clincher or unit 2.

In addition, in the electric stapler, because the papers 4 are pressed between the paper reference bases 5 and 5 downwardly by the lowering of the clincher unit 2, and therefore the staple is drive-out into the papers in their flexed state. As a result, there is a problem that an improper stapling is generated and misaligned papers are stapled and so on.

DISCLOSURE OF THE INVENTION

An object of the present invention is to prude an electric stapler and a driver unit in which even if a jam of a staple is generated, a cartridge can be removed out of a magazine.

Another object of the present invention is to provide an electric stapler configured to prevent a defective stapling from generating and to prevent miss-aligned papers from stapling.

To attain the former objects, the present invention is characterized in claim 1 by a driver unit comprising:

a movable frame attached movably upwardly and downwardly to a fixed frame;

a magazine attached to the movable frame for moving upwardly and downwardly together with the movable frame;

a cartridge which is attached attachably and detachably on the magazine and which contains sheet staples and which has at a leading end thereof a drive-out part for driving-out each of the sheet staples;

a driver which is attached in a front of the magazine and which is moved upwardly and downwardly relative to the magazine and which is mounted pivotally through a long hole of the movable frame on the fixed frame; and a biasing member for biasing the magazine in one of up and down directions and the driver relative to the magazine in the other of the up and down directions, the driver being entered relatively into the drive-out part by movement of the movable frame relative to the fixed frame against a biased force of the biasing member in accordance with movement of a moving means of a clincher unit toward the magazine in order to drive-out the staple, when the moving means of the clincher unit is moved apart away from the magazine, the movable frame and magazine being moved by the biasing member to be returned to an initial position, the magazine being mounted pivotally on the movable frame at a position apart from the drive-out part than the mounted point of the driver to be rotatable the magazine about its pivot relative to the movable frame.

To attain the latter object, the present invention is characterized in claim 4 by an electric stapler in which the driver unit is disposed downwardly, and the clincher unit is disposed upwardly of the driver unit, and comprising sheet receives provided on the opposite sides of the driver unit to become flush with an upper surface of the driver unit, the sheet receivers being lowered together with the lowering of the driver unit.

In claim 1, because the present invention is configured in such a manner that the magazine is mounted pivotally on the movable frame at the position apart from the drive-out part than the mounted point of the driver to be rotatable the magazine about its pivot relative to the movable frame, when the magazine is rotated relative to the movable frame, the driver can be returned to the initial position relative to the magazine.

In claim 4, because the present invention is configured in such a manner that the sheet receivers are lowered together with the lowering of the driver unit, it is avoided to drive the papers downwardly of the pair of sheet receivers by the lowering of the driver unit.

BEST MODE FOR CARRYING OUT THE INVENTION

Modes for out an electric stapler according to the present invention will be explained with reference to the accompanying drawings below.

[First Model]

Figure 1:
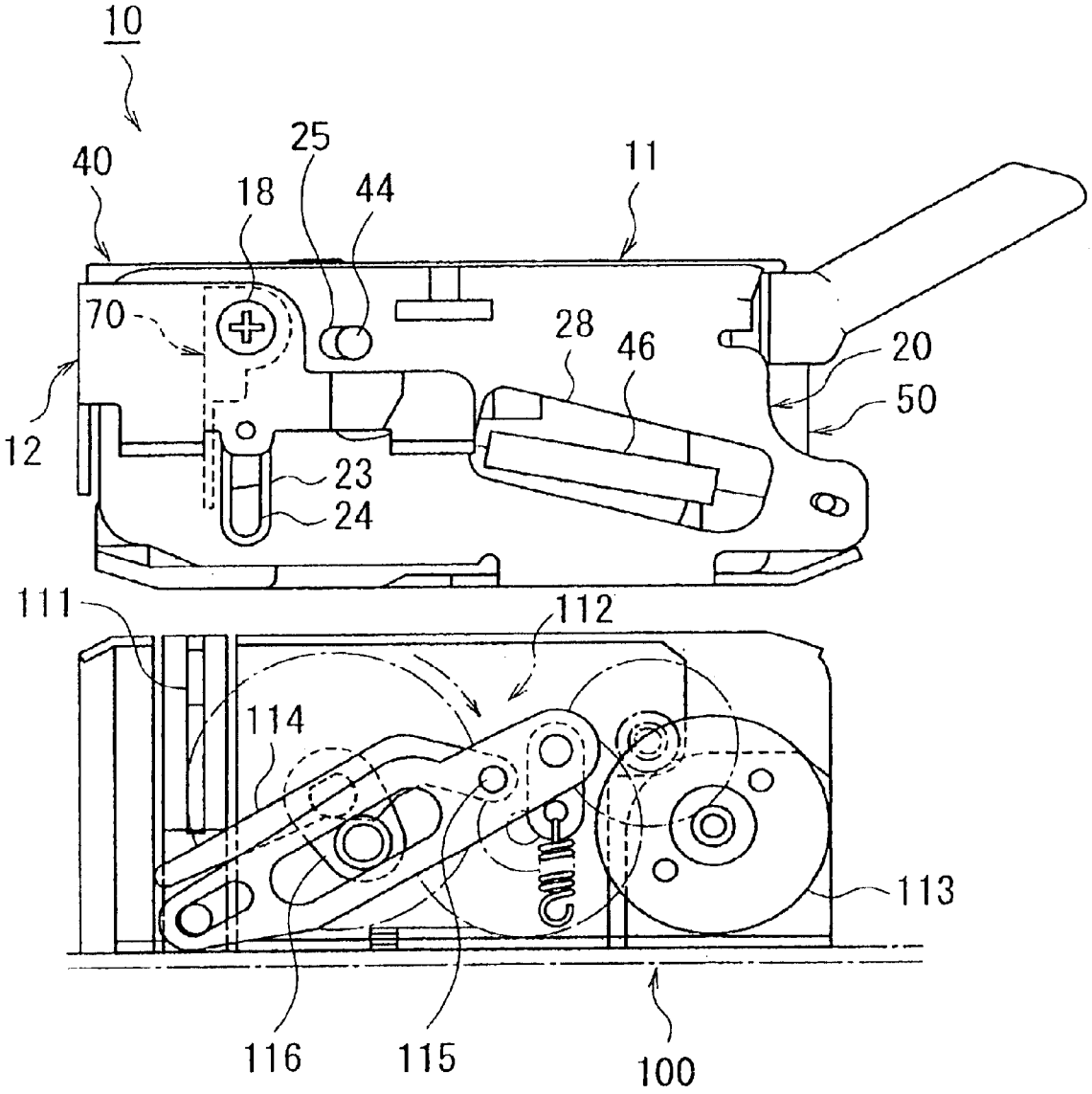
FIG. 1 is a schematic explanatory view showing a structure of an electric stapler according to the present invention.

In FIG. 1, reference number 10 is an electric stapler of an upwardly and downwardly separated type. The electric stapler 10 is composed of a driver unit 11 and a clincher unit 100 disposed below the driver unit 11. The electric stapler 10 is mounted, for example, on a copying machine or the like.

The clincher unit 100 comprises a clincher part (lifting means) 111 which is a moving means provided movably upwardly and downwardly, an up and down mechanism 112 for moving upwardly and downwardly the clincher part 111, a motor 113 for driving the up and down mechanism 112 and so on. Reference numeral 114 is a clincher arm for rotating a clincher (not shown). The clincher arm 114 is adapted to rotate about a shaft 115. The rotation of the clincher arm 114 is carried out by a rotation of a cam 116.

Figure 2:
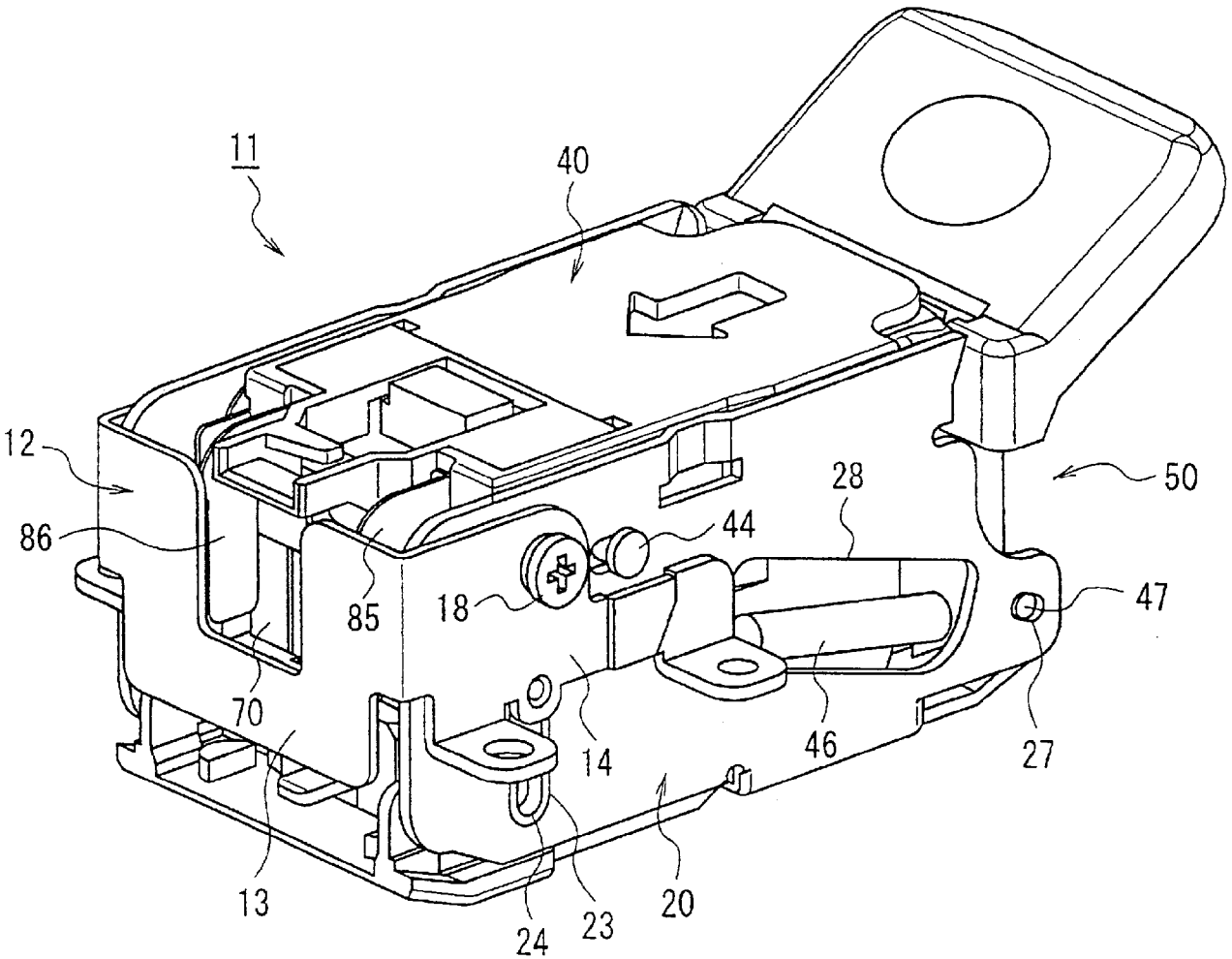
FIG. 2 is a perspective view showing a driver unit in the electric stapler.
Figure 3:
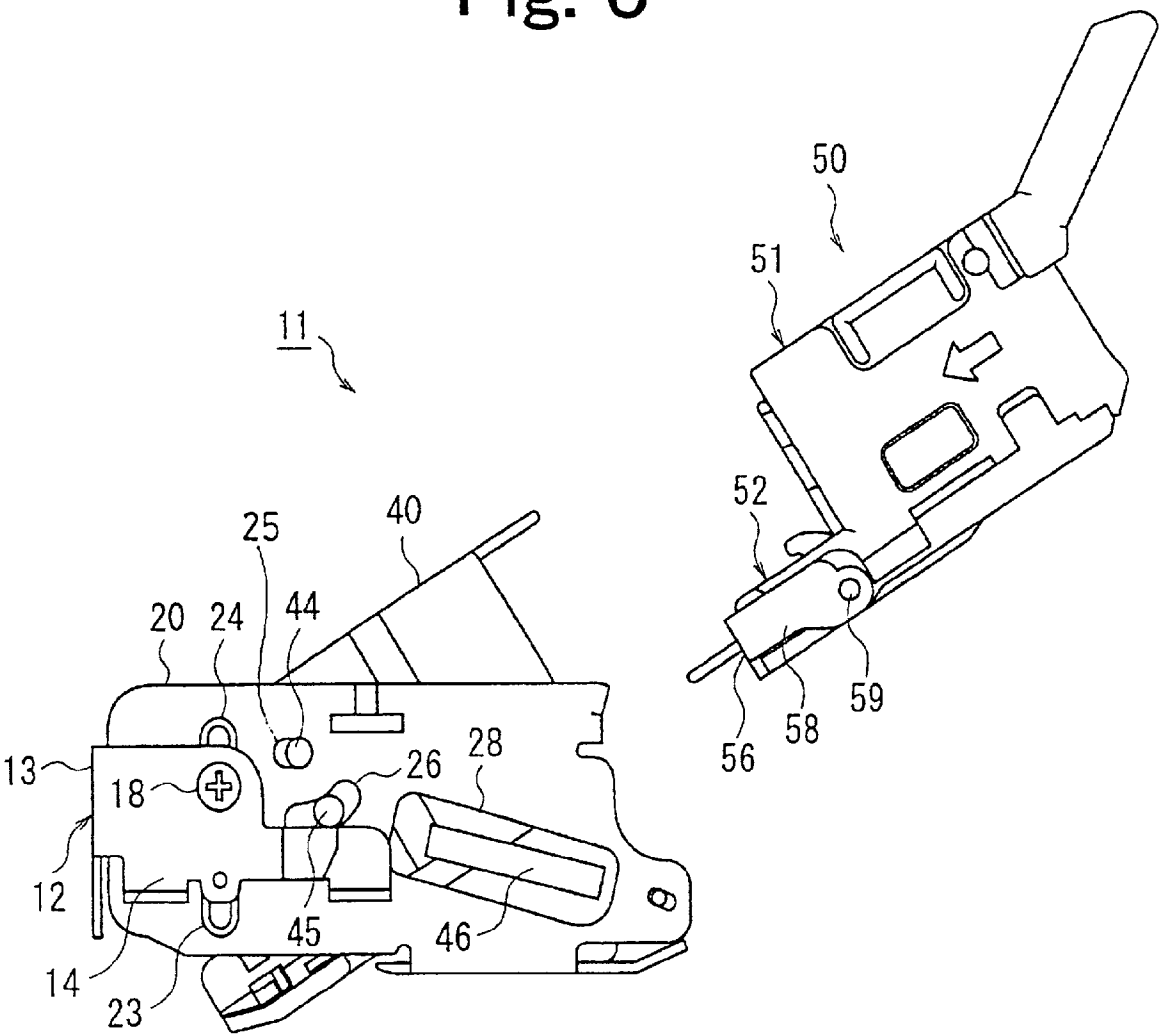
FIG. 3 is an explanatory view showing a schematic structure of the driver unit.
Figure 4:
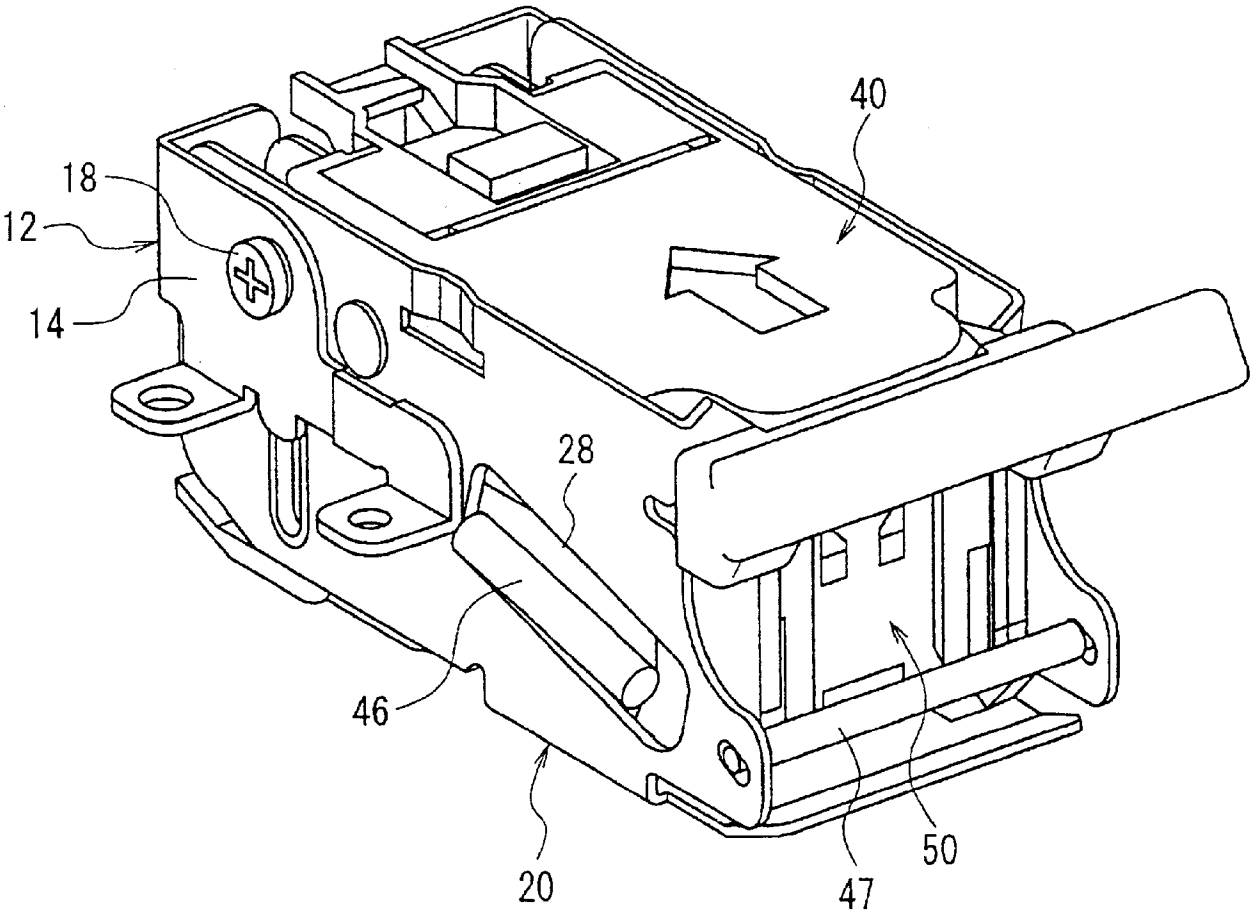
FIG. 4 is a perspective view showing a back portion of the driver unit.
Figure 12:
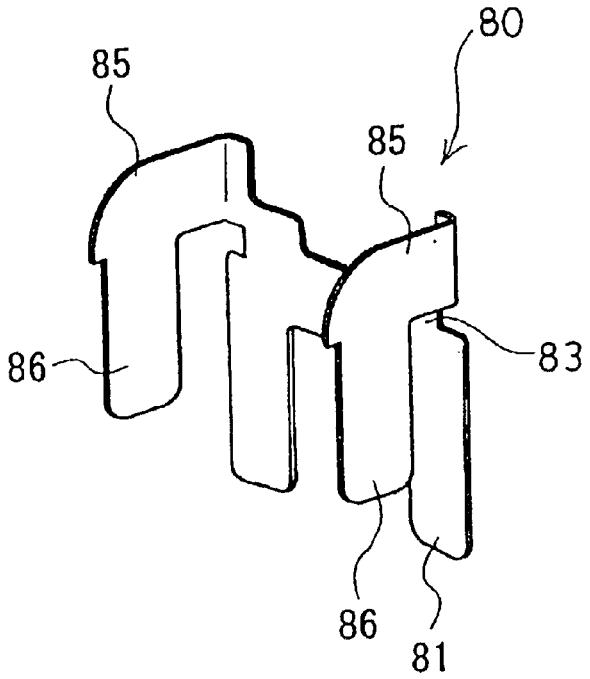
FIG. 12 is a perspective view showing a forming plate.

As shown in FIGS. 2 to 4, the driver unit 11 comprises a fixed frame 12 fixed to a base (not shown), an inner frame or movable frame 20 mounted movably upwardly and downwardly on the fixed frame 12, a magazine 40 attached movably inwardly of the inner frame 20, a cartridge 50 attached removably to the magazine 40, a driver 70 attached movably upwardly and downwardly to the magazine 40, and a forming plate 80 as shown in FIG. 12, and so on.

Figure 5:
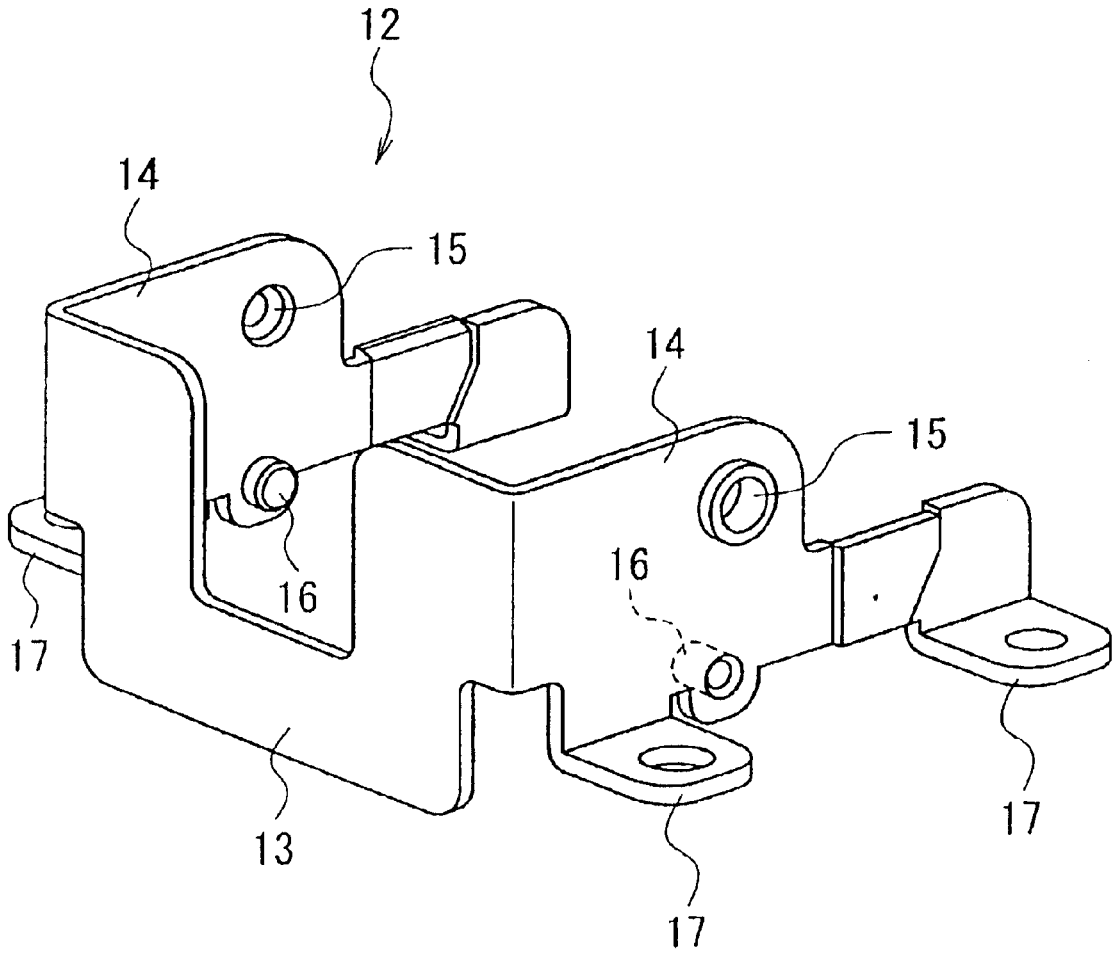
FIG. 5 is a perspective view showing a structure of a fixed frame.

The fixed frame 12 is formed in a U shape as viewed from a plane as shown in FIG. 5 and has a front plate portion 13 and side plate portions 14 extending from both sides of the front plate 13. The side plate portions 14 are provided at upper portions thereof with threaded holes 15 and downwardly of the threaded holes 15 with inwardly projected circular protrusions 16. Screws 18 are threaded into the threaded holes 15, as shown in FIGS. 1 to 4. Reference numeral 17 is an attachment part for fixing the base (not shown).

Figure 6:
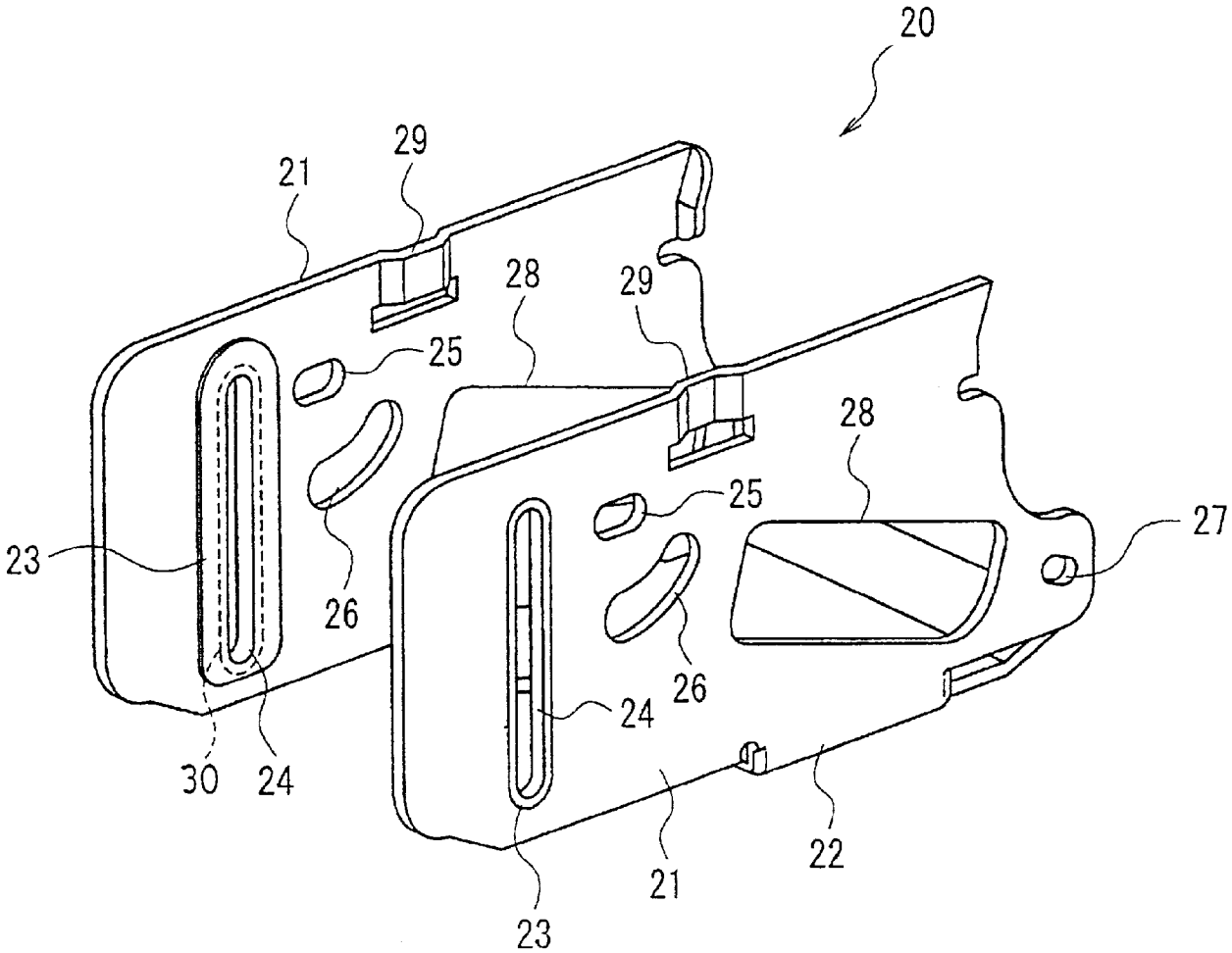
FIG. 6 is a perspective view showing a structure of an inner frame.

The inner frame 20 has a pair of side plates 21 and 21 and a bottom plate 22 for connecting bottom portions of the side plates 21 and 21, Each of the side plates 21 and 21 is formed at forward position with a slit-shaped long hole 30 extending upwardly and downwardly in which a bush 23 is inserted. Each bush 23 is provided with an upwardly and downwardly extending long hole 24. Each side plate 21 is also provided with a long hole 25 extending slightly rightward and leftward backwardly of the long hole 30 (right side in FIG. 6), a circular shaped long hole 26 downwardly of the long hole 25, a long hole 27 formed obliquely downwardly of a back portion of the side plate, and a large hole extending forwardly and backwardly between the long holes 26 and 27. An inwardly project protrusion 29 is provided on an upper intermediate position of each side plate 21.

Figure 7:
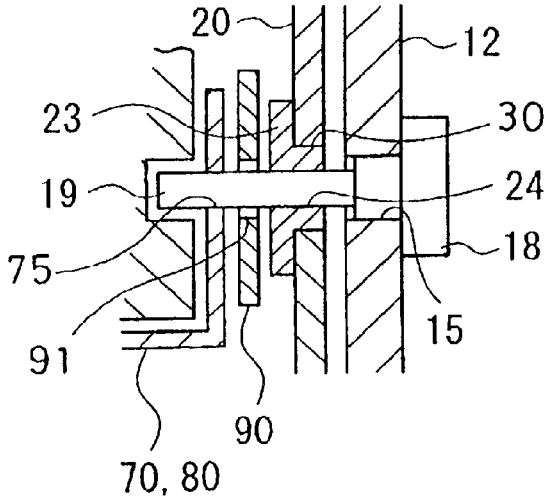
FIG. 7 is a sectional view showing a mounted relationship between the fixed frame and a magazine.
Figure 8:
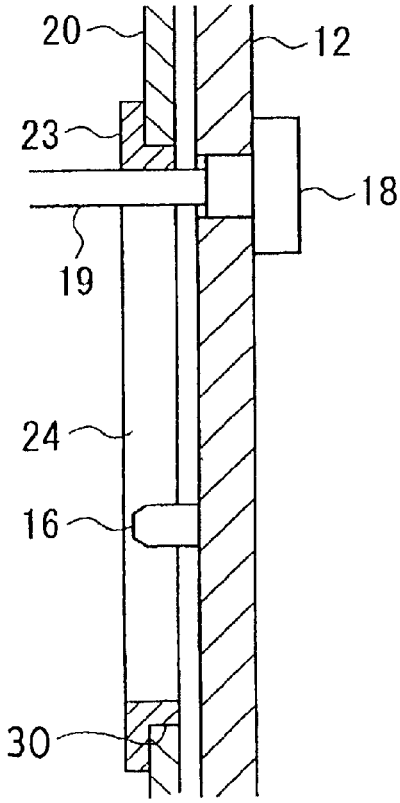
FIG. 8 is an enlarged sectional view showing the mounted relationship between the fixed frame and the magazine.

As shown in FIGS. 7 and 8, a shaft 19 of the screw 18 threaded in each threaded hole 15 of the fixed frame 12 is inserted in an upper position in the long hole 24 of the bush 23 attached to each of the side plates 21 in the inner frame 20 and each protrusion 16 of the fixed frame 12 is inserted in a lower position in each long hole 24. With the structure, the inner frame 20 is adapted to carry out a parallel movement upwardly and downwardly along the fixed frame 12. More specifically, the inner frame 20 is movable in parallel upwardly and downwardly along the long holes 24 of the bushes 23 of the fixed frame 12, in other words, the long holes 30 of the fixed frame 12.

Figure 9:
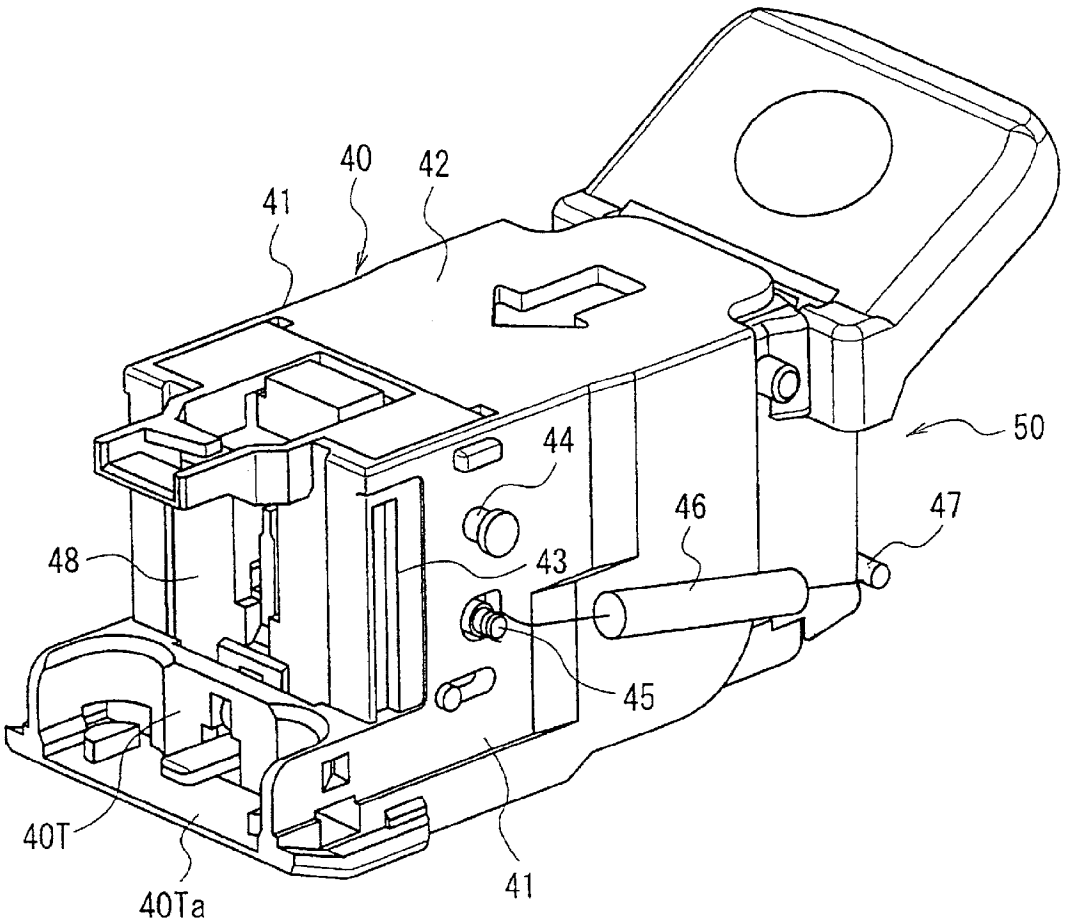
FIG. 9 is a perspective view showing the magazine on which a cartridge is mounted.
Figure 10:
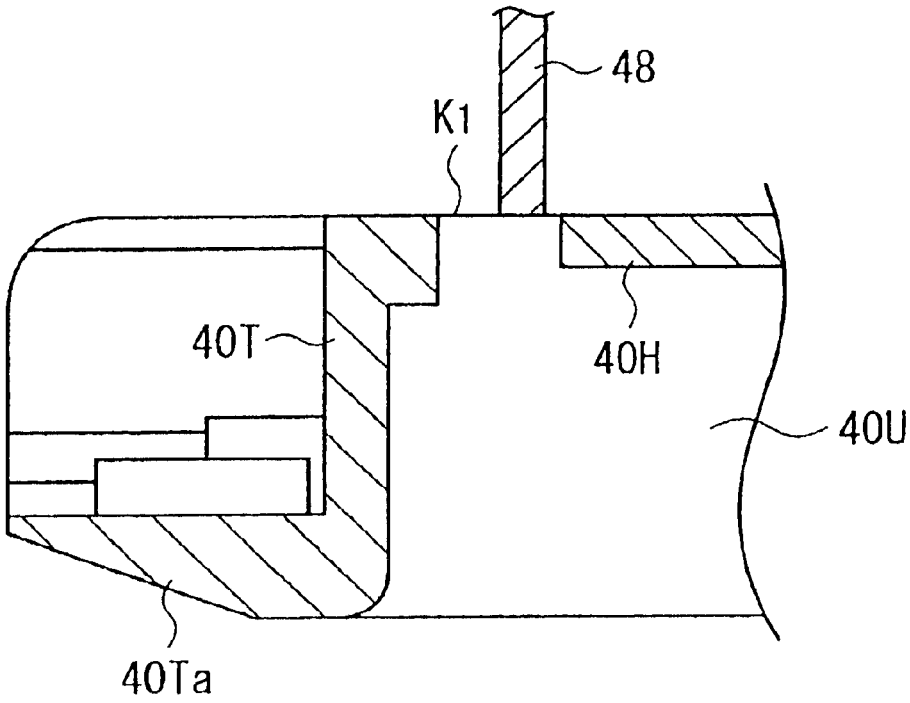
FIG. 10 is a partial enlarged view showing a structure of a front portion in a lower area of the magazine.

As shown in FIG. 9, the magazine 40 has sidewall portions 41 and a top plate wall portion 42 and a front wall portion 48 and so on by which a room (not shown) is formed for mounting the cartridge 50. In a lower portion of a front side (left side in FIG. 9) of the magazine 40 is formed a space K1 in which the driver 70 and forming plate 80 are inserted between an upper portion of a front wall portion 40T and a lower portion of the front wall portion 48, and the magazine 40 is provided with a lower guide wall 40H, as shown in FIG. 10. A space 40U in which a transport part 50 (which will be explained below) of the cartridge 50 is inserted, is formed under the lower guide wall 40H. In a forward side of each side wall portion 41 is formed an upwardly and downward extending guide groove 43 and a shaft 44 is disposed passing through the side wall portions 41 and 41 at a backward position of the guide groove 43. Each sidewall portion 41 is provided at a lower position of the shaft 44 with a protrusion 45. One end of a spring 46 is attached to the protrusion 45 and the other end of the 46 is attached to a shaft 47. The opposite ends of the shaft 47 are inserted in the long holes 27 and 27 of the side plates 21 and 21 of the inner frame 20 to attach the shaft 47 to the side plates 21 and 21.

The opposite ends of the shaft 44 extending between the side wall portions 41 of the magazine 40 are inserted in the long holes 25 of the side plates 21 of the inner frame 20, respectively, the protrusions 45 of the magazine 40 are inserted in the long holes 26 of the inner frame 20 to move relatively the magazine 40 and inner frame 20 along the long holes 26, and the magazine 40 is rotatable about the shaft 44. In other words, the magazine 40 is rotatably supported on the side plates 21 of the inner frame 20 by the shaft 44.

Figure 11:
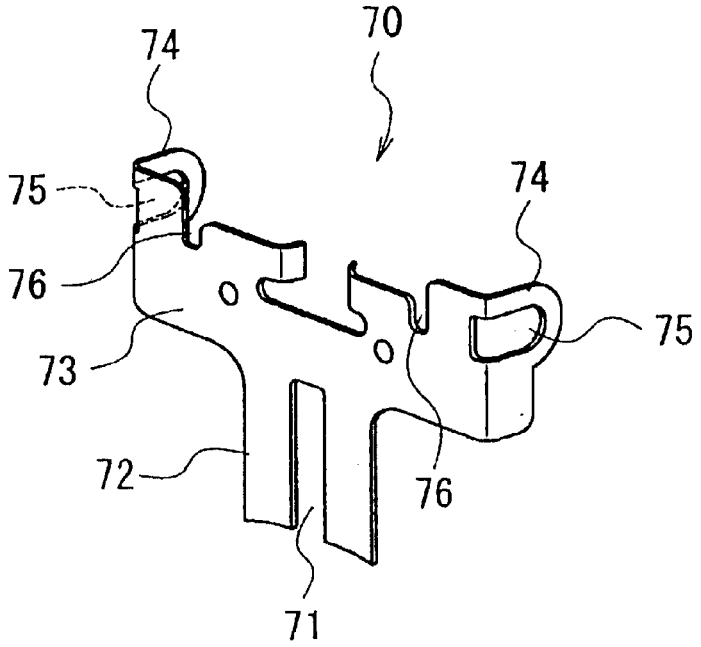
FIG. 11 is a perspective view showing a driver.

As shown in FIG. 11, the driver 70 includes driver plate portions 72 having an upwardly and downwardly extending cutout 71, a basic plate portion 73 which extends rightward and leftward on upper portions of the driver plate portions 72 and projected portions 74 extending backwardly from the opposite sides of the basic plate portion 73. Long holes 75 are provided in the projected portions 74. Cutouts 76 are formed in the opposite sides in an upper portion of the basic plate portion 73.

As shown in FIG. 12, the forming plate 80 has forked forming plate portions 81, a basic plate portion 83 formed upwardly of the forming plate portions 81, projecting portions 85 extending forwardly from the opposite sides of the basic plate portion 83, and supporting portions 86 extending downwardly from the projecting portions 85.

Figure 13:
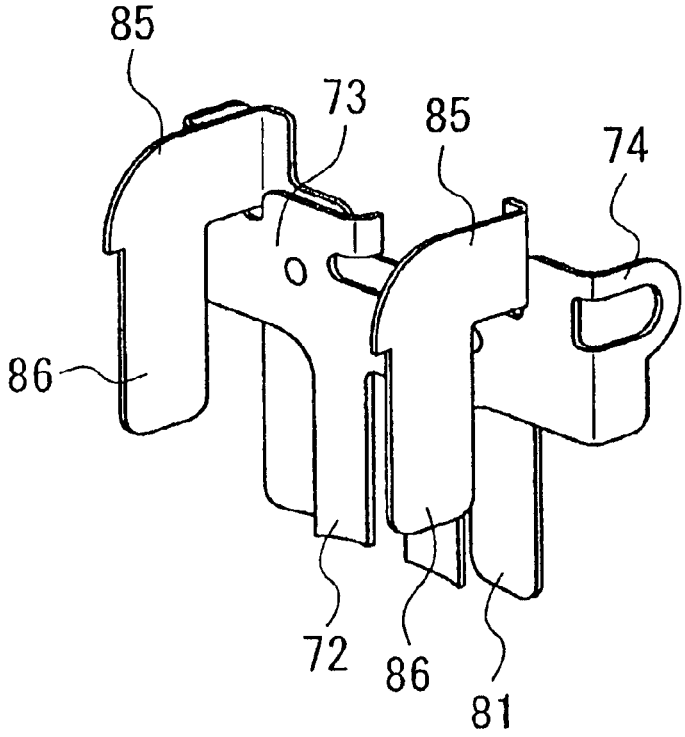
FIG. 13 is a perspective view showing an overlapped state of the driver and forming plate.
Figure 14:
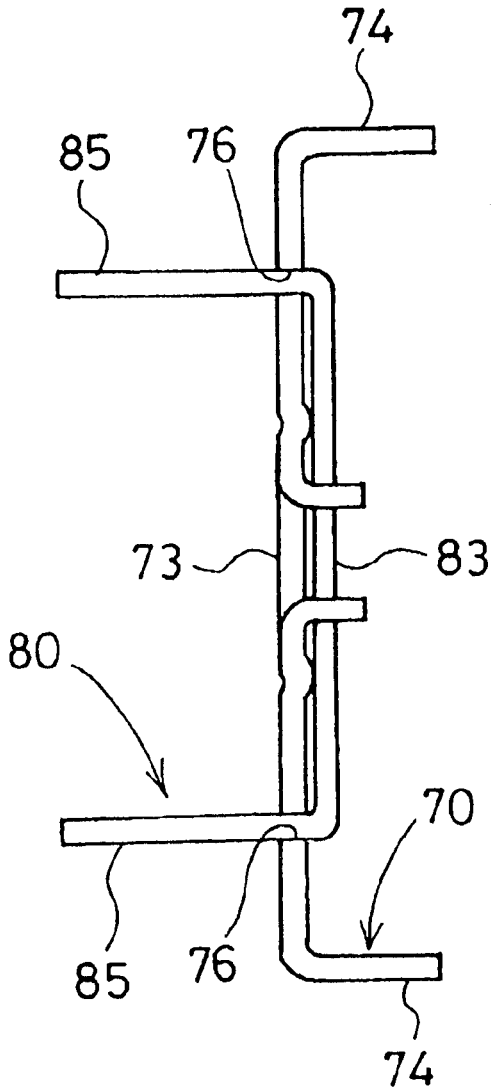
FIG. 14 is a plan view showing the overlapped state of the driver and forming plate.
Figure 15:
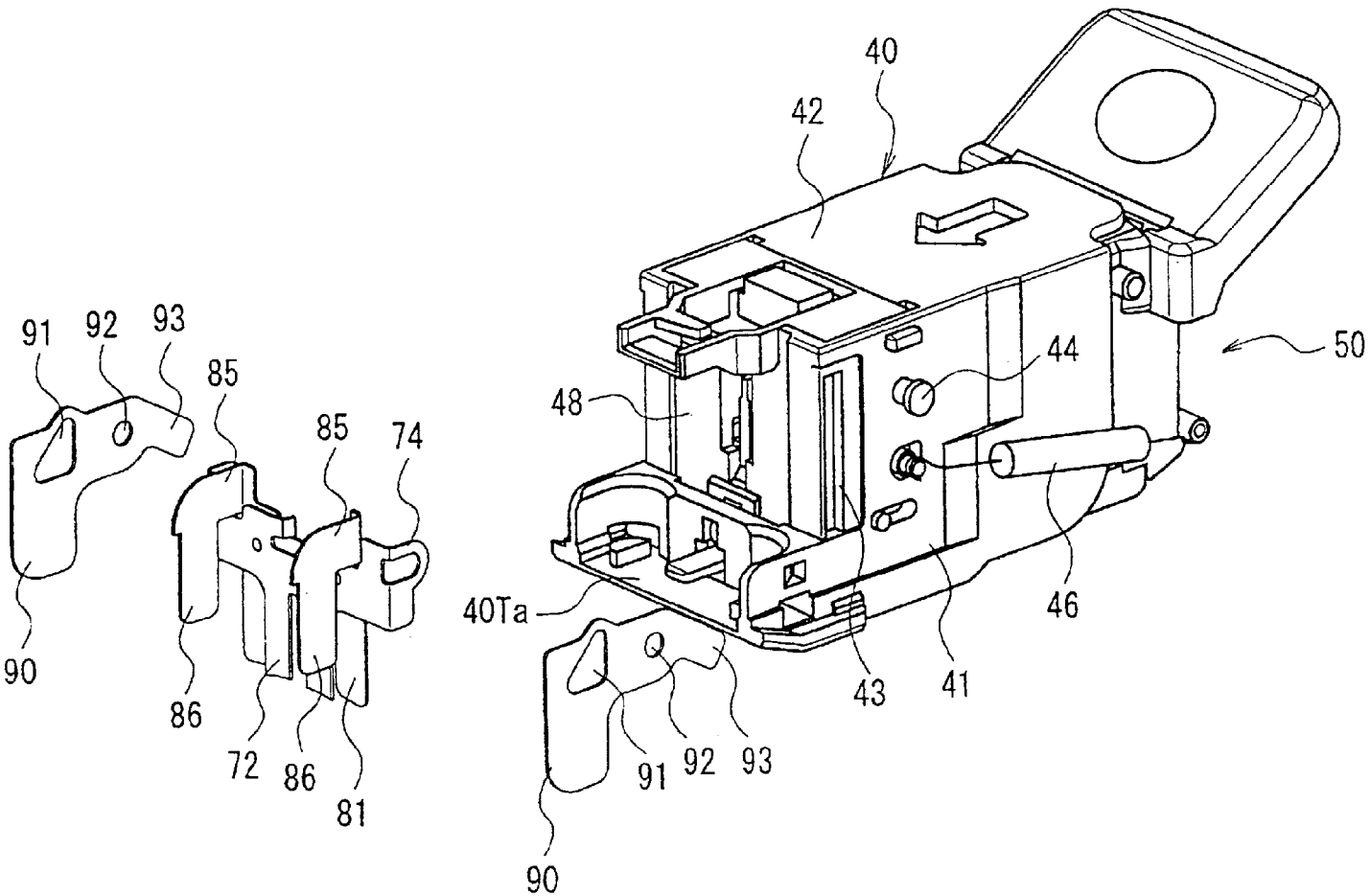
FIG. 15 is an explanatory view showing the magazine, a link member, the driver and the forming plate.

As shown in FIGS. 13 to 15, the forming plate 80 is mounted on the driver 70 in such a manner that the forming plate portions 81 are overlapped behind of the driver plate portions 72 and the projecting portions 85 of the forming plate 80 are inserted in the cutouts 76 of the basic plate portion 73 of the driver 70.

The driver 70 and forming plate 80 are mounted movably upwardly and downwardly on the front wall portion 48 of the magazine 40 (see FIG. 16, in addition, in FIG. 16, the forming plate 80 is omitted), and the shafts 19 of the screws 18 threaded in threaded holes 15 of the fixed frame 12 are inserted in the long holes 75 and 75 of the projected portions 74 and 74 and then leading ends of the shafts 19 are inserted in the guide grooves 43 of the magazine 40, as shown in FIG. 7.

Figure 17:
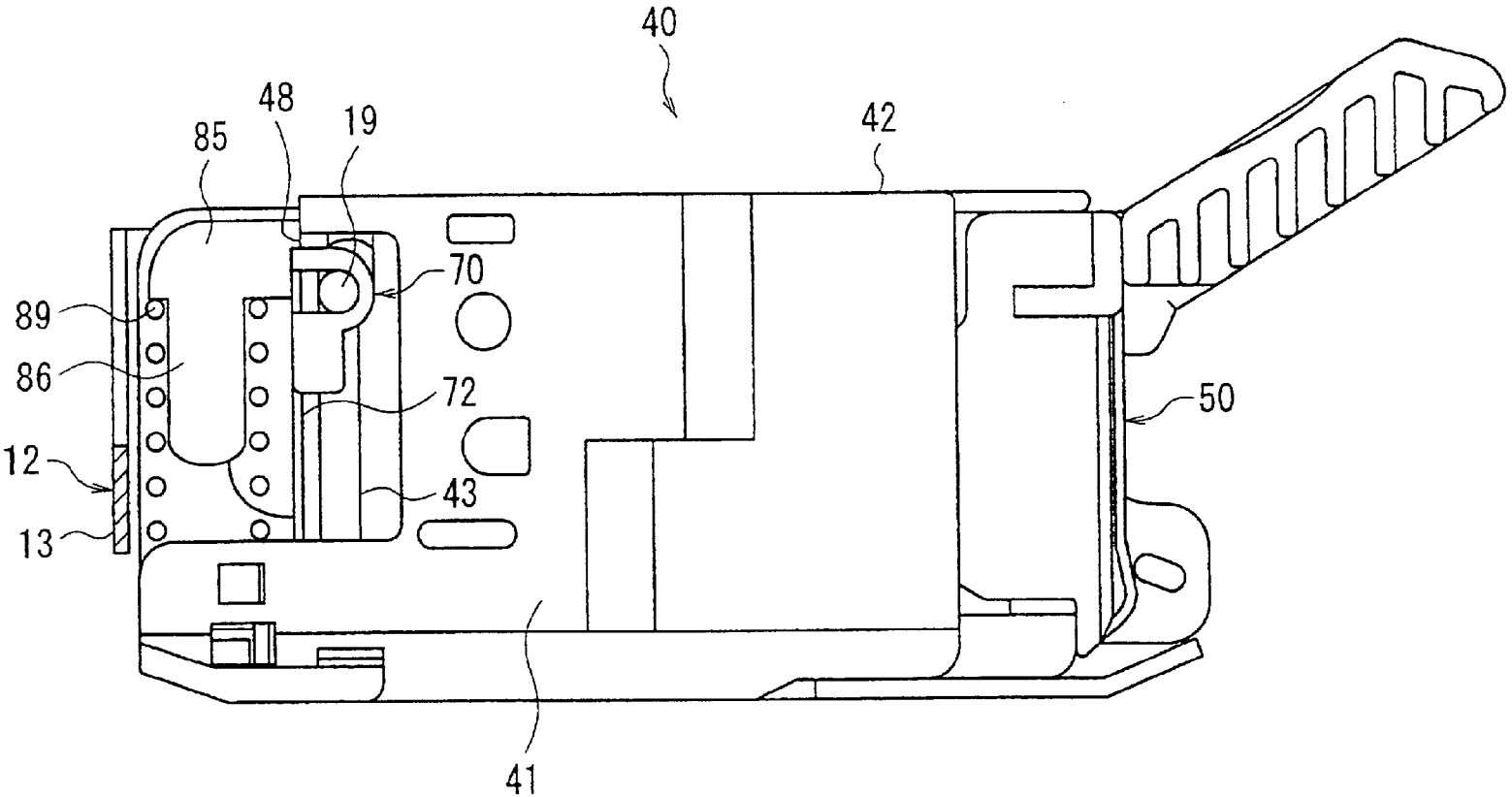
FIG. 17 is a side view showing the magazine.

In other words, as shown in FIG. 17, the driver 70 and forming plate 80 are fixed to the fixed frame 12 at a level shown in the drawings by means of the screws 18. Moreover, when the inner frame 20 and magazine 40 are lifted relative to the fixed frame 12, the driver 70 and frame plate 80 are lowered relatively to the magazine 40. As a result, the driver 70 and forming plate 80 are moved upwardly and downwardly relatively along the front wall portion 48 of the magazine 40 in response to up and down movements of the inner frame 20 and magazine 40.

Figure 18:
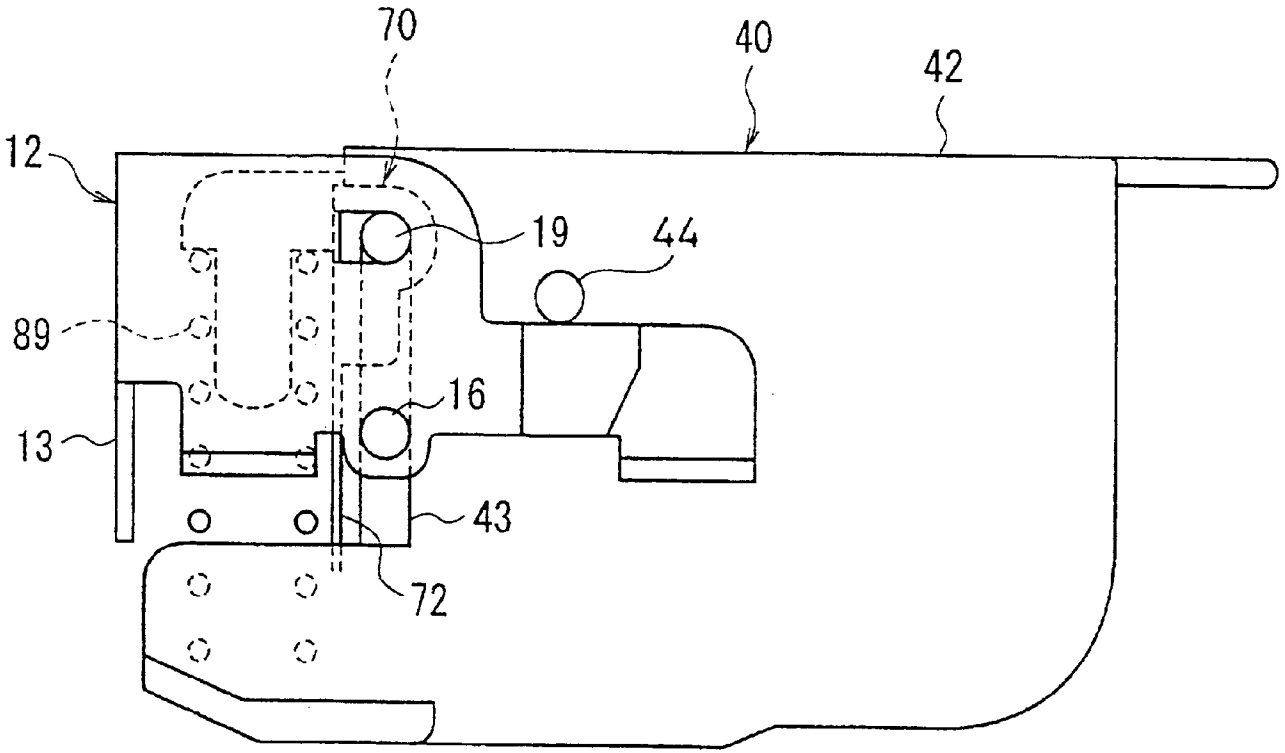
FIG. 18 is an explanatory view showing a relationship between the fixed frame and magazine.

A spring or biasing member 89 is engaged at one end with the projecting portion 85 of the forming plate 80 and at the other end with a projecting wall portion 40Ta (see FIG. 10) of the front wall portion 40T of the magazine 40. The supporting portions 86 of the forming plate 80 are inserted in the 89 and carry the spring 89. By the spring 89, the driver 70 and forming plate 80 are biased upwardly relative to the magazine 40. In other words, the magazine 40 is biased downwardly relative to the fixed frame 12 by the spring 89, as shown in FIG. 18.

Figure 16:
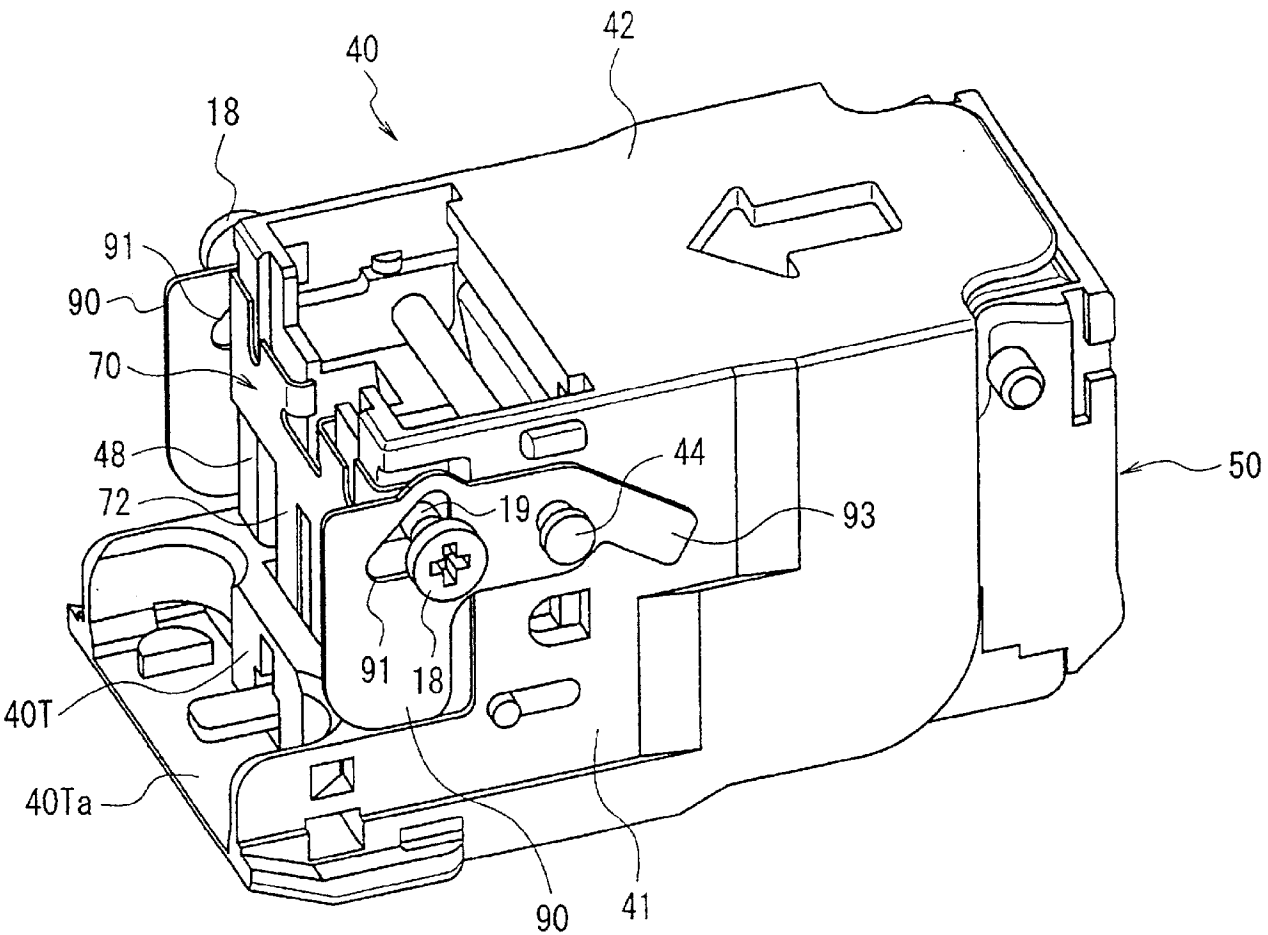
FIG. 16 is an explanatory view showing a state that the driver and link member are mounted on the magazine.

A pair of link members 90 is provided between the projected portions 74 of the driver 70 and inner frame 20, as shown in FIGS. 7, 15 and 16, Each link member 90 is formed in a L-character shape as shown in FIGS. 15 and 16. The link member 90 is formed at an intermediate portion with a triangle hole 91 and with a shaft hole 92 backwardly of the triangle hole 91. The link member 90 is also provided with a stopper portion 93 extending backwardly and obliquely downwardly in a backward position of the shaft hole 92. The opposite end of the shaft 44 of the magazine 40 are inserted in the shaft holes 92 of the link members 90 and the shafts of the screws 18 threaded in fixed frame 12 are inserted loosely in the triangle holes 91 of the link members 90.

Figure 23:
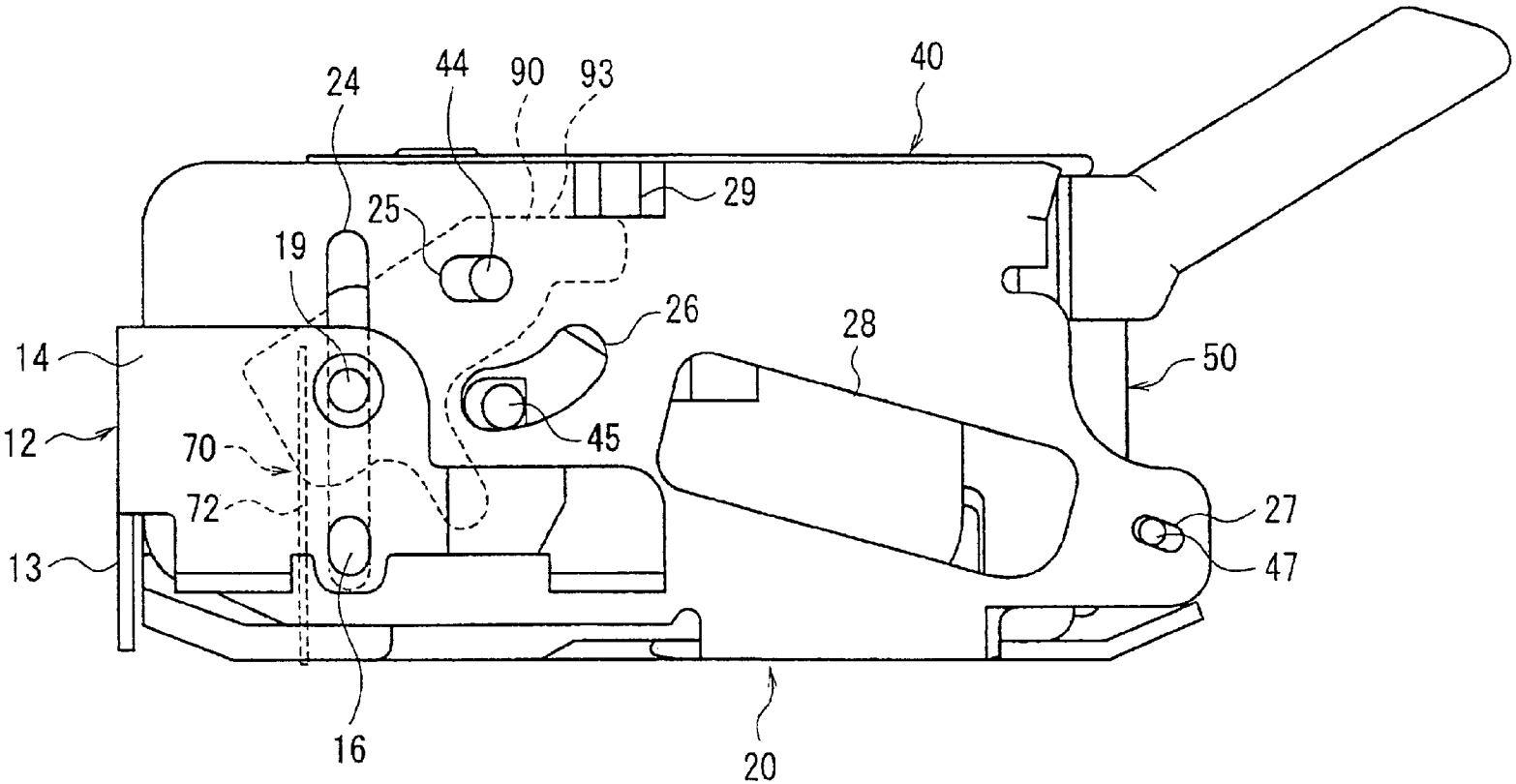
FIG. 23 is an explanatory view showing a state that the lifting of the magazine is stopped by means of the link member.

When the magazine 40 is lifted relative to the fixed frame 12, the link member 90 are rotated about the shafts 44 counterclockwise and then the stopper portions 93 are abutted with the protrusions 29 to stop the lifting of the magazine 40 at a predetermined height position (see FIG. 23).

Figure 19:
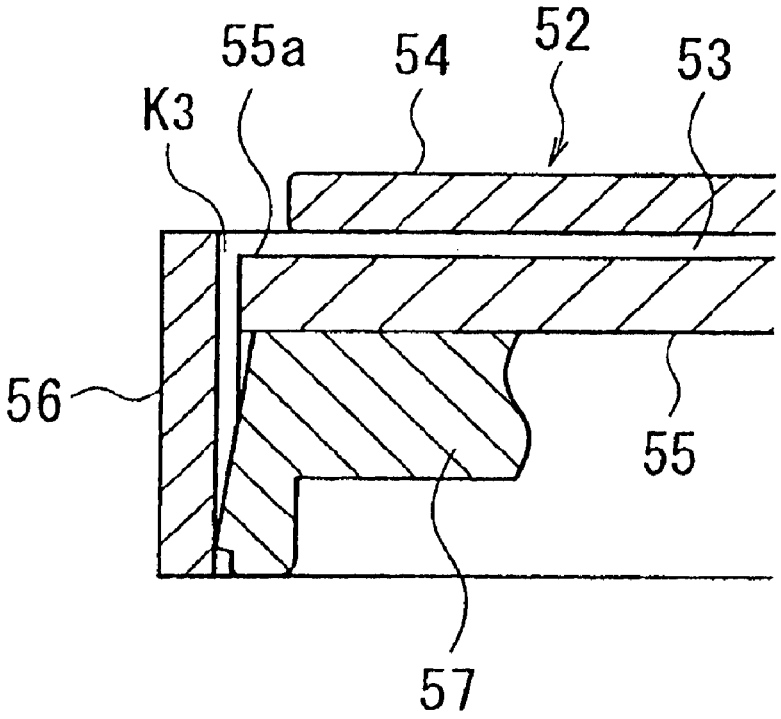
FIG. 19 is an enlarged partial view showing a structure of a transport part of the cartridge.

The cartridge 50 has a containing part 51 for containing stacked sheet staples (not shown) and the transport part 52 (as described above) projecting leftward at a lower position of the containing part 51. As shown in FIG. 19, the transport part 52 has guide plates 54 and 55 forming a transport path 53 for transporting the sheet staple, a faceplate 56 disposed forwardly of the guide plates 54 and 55 and a pusher 57 disposed under the guide plate 55. On a front part of the transport part 52 is provided a drive-out part for driving out the sheet staple.

Formed between a front surface of the guide plate 55 and faceplate 56 is a space K3 in which the driver plate portions 72 of the driver 70 are inserted from above to beneath. The front surface of the guide plate 55 is formed into an anvil portion 55*a* for forming the sheet staple in a U shape. The pusher 57 is biased forwardly by a spring (not shown). The opposite ends of the faceplate 56 are provided with side plate portions 58 extending backwardly (rightward in FIG. 3) whose back portions are pivoted. The faceplate 56 is rotatable about a shaft 59, counterclockwise. If the sheet staple is jammed between the faceplate 56 and pusher 57, the jammed sheet staple can be removed by rotating counterclockwise the faceplate 56.

[Operation]

An operation of the electric stapler configured as described above will be explained as follows.

First the cartridge 50 is mounted in the magazine 40. When the cartridge 50 is mounted in the magazine 40, the transport part 52 of the cartridge 50 is inserted in the space 40U of the magazine 40. When the magazine 40 on which the cartridge 50 is mounted is set in the inner frame 20 in a state shown in FIGS. 1 and 2, of a back portion of the containing part 51 of the cartridge 50 is pressed and held by the shaft 47 of the inner frame 20, as shown in FIG. 4.

The inner frame 20 and magazine 40 are positioned in a lowered position or an initial position as shown in FIG. 1 relative to the fixed frame 12 by the spring 89, before the clincher portion 111 of the clincher unit 100 is lifted. When the inner frame 20 and magazine 40 are positioned in the initial position, front end portions or lower ends 72*a* of the driver plate portions 72 of the driver 70 are entered in the space K1 of the magazine 40 and positioned upwardly (initial position) of the space K3 of the transport part 62 of the cartridge 50.

In the state, when a bundle of sheets (not shown) is fed between the driver unit 10 and clincher unit 100 and is disposed on an upper surface of the driver unit 10, a staple signal is outputted from a copying machine or the like (not shown), for example, to drive the moor 113 of the clincher unit 100. The up and down mechanism 112 causes the clincher part 111 to lift by the driving of the motor 113.

When the clincher part 111 is to a predetermined position, it abuts through the bundle of sheets with a lower portion of the magazine 40 and then the inner frame 20 and magazine 40 are lifted relative to the fixed frame 12 against the spring 89 in accordance with the lifting of the clincher part 111. When the inner frame 20 and magazine 40 are lifted to a position as shown in FIGS. 21 to 23, the stopper portion 93 of the link member 90 abuts with the protrusion 29 of the inner frame 20 to stop the lifting of the magazine 40.

On the other hand, the driver 70 is lowered relative to the magazine 40 pursuant to the lifting of the magazine 40, and by the lowering of the driver, the leading ends of the driver plate portions 72 of the driver 70 are entered in the space K3 of the transport part 52 of the cartridge 50. When the magazine 40 is lifted to the position as shown in FIGS. 21 to 23, the driver plate portions 12 are inserted between the faceplate 56 and pusher 57 to drive out the sheet staple. The driven sheet staple penetrates the bundle of sheets.

Figure 21:
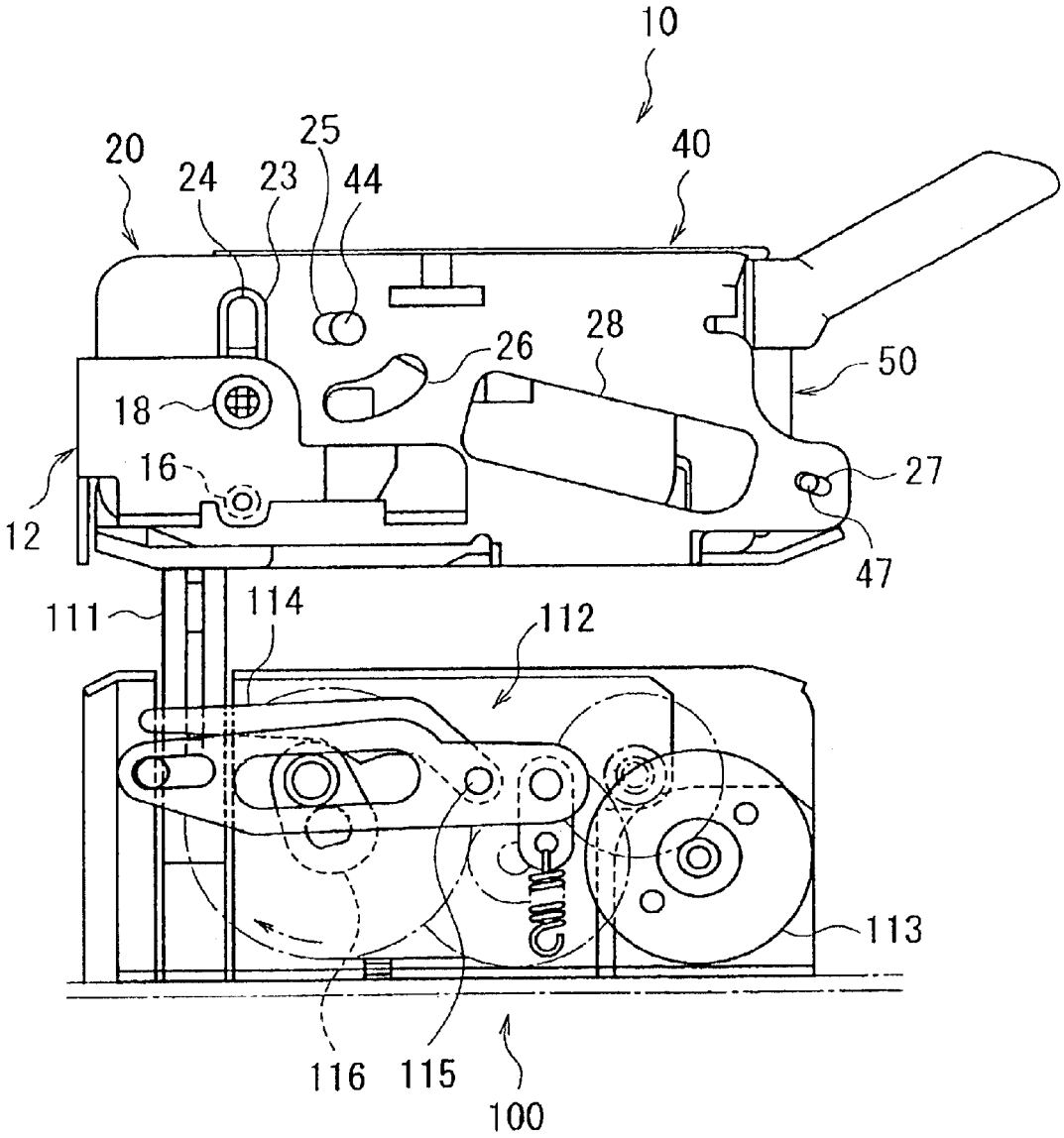
FIG. 21 is a total explanatory view showing a state that the magazine and inner frame are lifted relative to the fixed frame.
Figure 22:
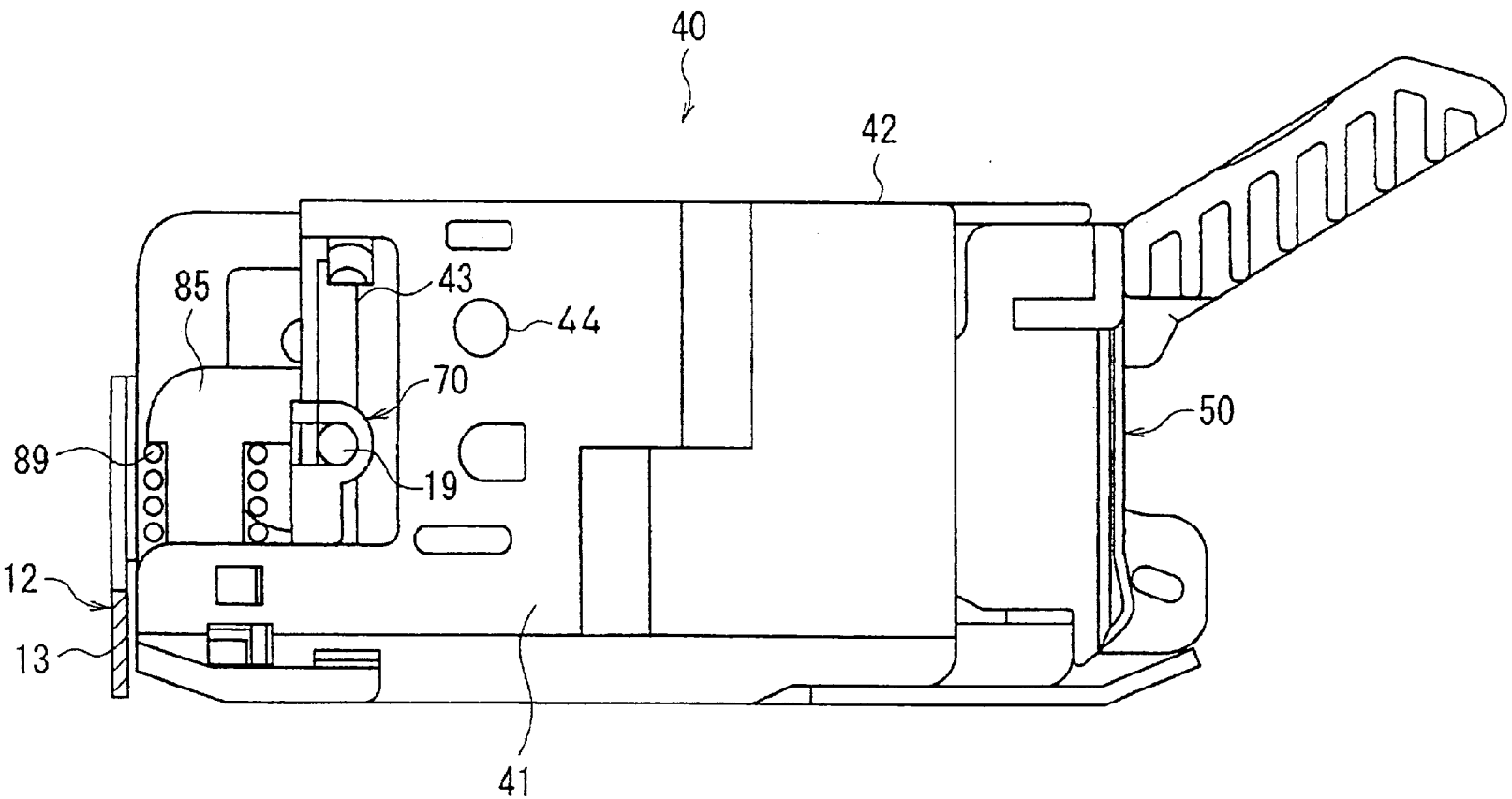
FIG. 22 is an explanatory view showing a state the magazine is liked relative to the fixed frame.

When the lifting of the magazine 40 is stopped, the clincher arm 114 is rotated about the shaft 115 from the position shown in FIG. 21 clockwise by the rotation of the cam 116 to rotate the clincher, which is not shown. By the rotation of the clincher, legs of the staple, which penetrate the bundle of sheets, are clinched. At the time the clincher is rotated, the magazine 40 is stopped at the position as shown in FIG. 23 by the link member 90 not to lift from the position, therefore the clincher operation can be carried out firmly.

Figure 20:
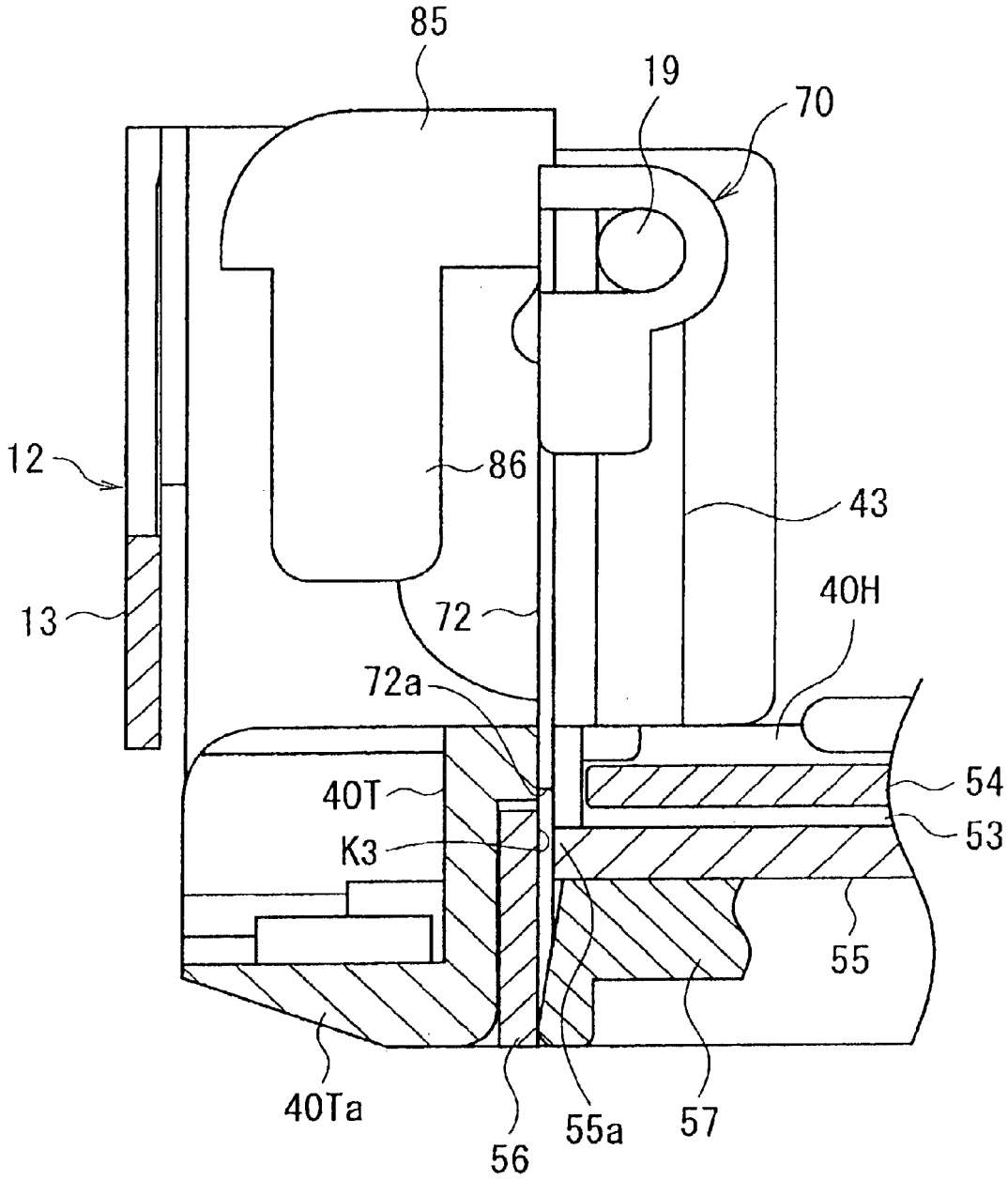
FIG. 20 is an explanatory view showing an initial position of the driver.

If the clincher is completed, the clincher part 111 of the clincher unit 100 is lowered. By the lowering of the clincher part 111, the magazine 40 and inner frame 20 are lowered by the spring 89 in accordance with the lowering of the clincher part. In response to the lowering of the magazine 40, the driver 70 is lifted relative to the magazine 40, and then the magazine 40 and inner frame 20 are returned to the initial position shown in FIG. 1. When the magazine 40 is returned to the initial position, the driver 70 is also returned to the initial position shown in FIG. 20.

In addition, the forming plate 80 is moved upwardly and downwardly together with the driver 70 to form the staple in a U-character shape, similarly as in a conventional electric stapler. The detailed description is omitted.

Figure 24:
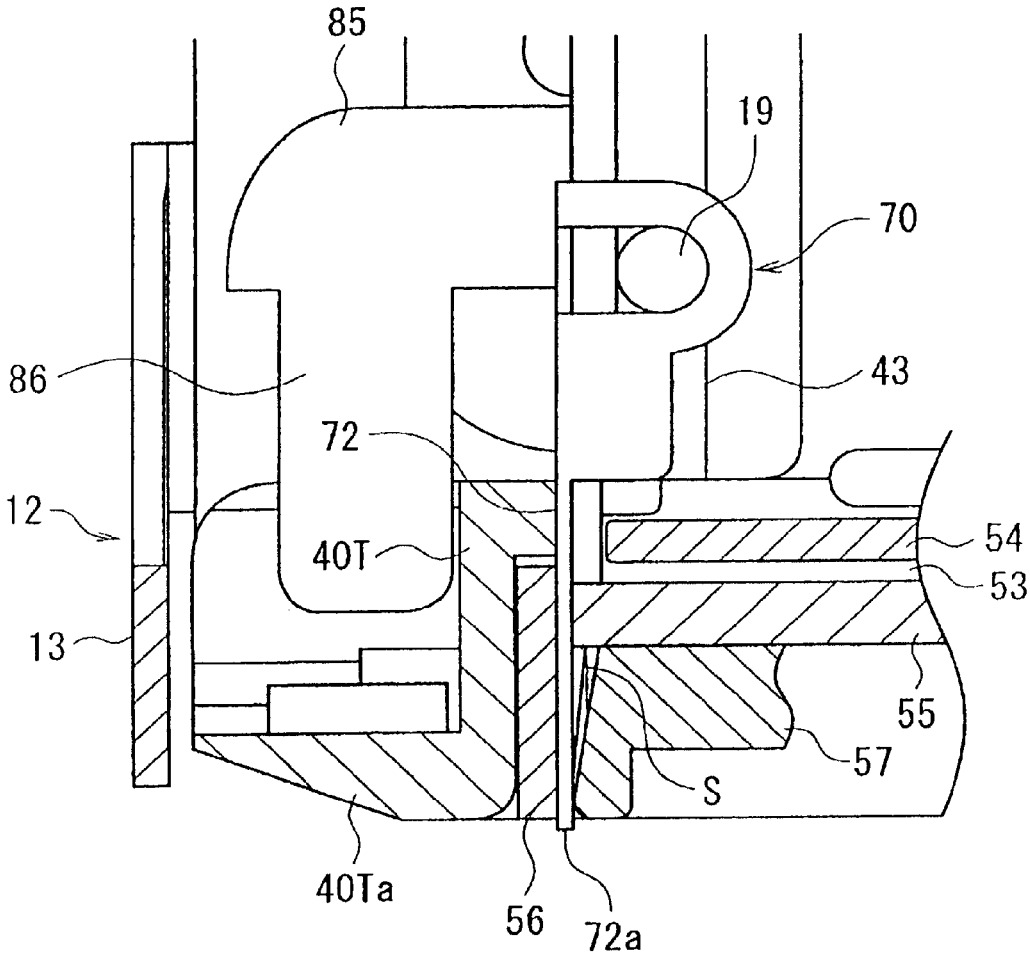
FIG. 24 is an explanatory view showing a state at the time a staple is driven out by the lowering of the driver relative to the frame.

As shown in FIG. 24, if the jamming is generated in driving out the staple by the driver 70, in other words, if the staple is jammed between the faceplate 56 and pusher 57, the driver plate portions 72 become a fixed state into the position shown in FIG. 24, even if the clincher part 111 of the clincher unit 100 is lowered, the magazine 40 and inner frame 20 cannot be lowered by the biasing force of the spring 89. In other words, if there becomes in a state that the driver plate portions 72 of the driver 70 are inserted between the faceplate 56 and pusher 57 relative to the fixed frame 12, as shown in FIG. 25, the cartridge 50 cannot be removed out of the magazine 40.

Subsequently, from the state shown in FIG. 25, the magazine 40 is rotated about the shaft 44 relative to the inner frame 20 or the fixed frame 12 counterclockwise. If the magazine 40 is rotated about the shaft 44 counterclockwise as shown in FIG. 26, because the driver 70 is fixed in a height position by the shafts of the screws 18 of the fixed frame 12 and is rotated about the shafts 19, the driver plate portions 72 of the driver 70 are removed from between the faceplate 56 and pusher 57 with the rotation of the magazine 40.

Figure 25:
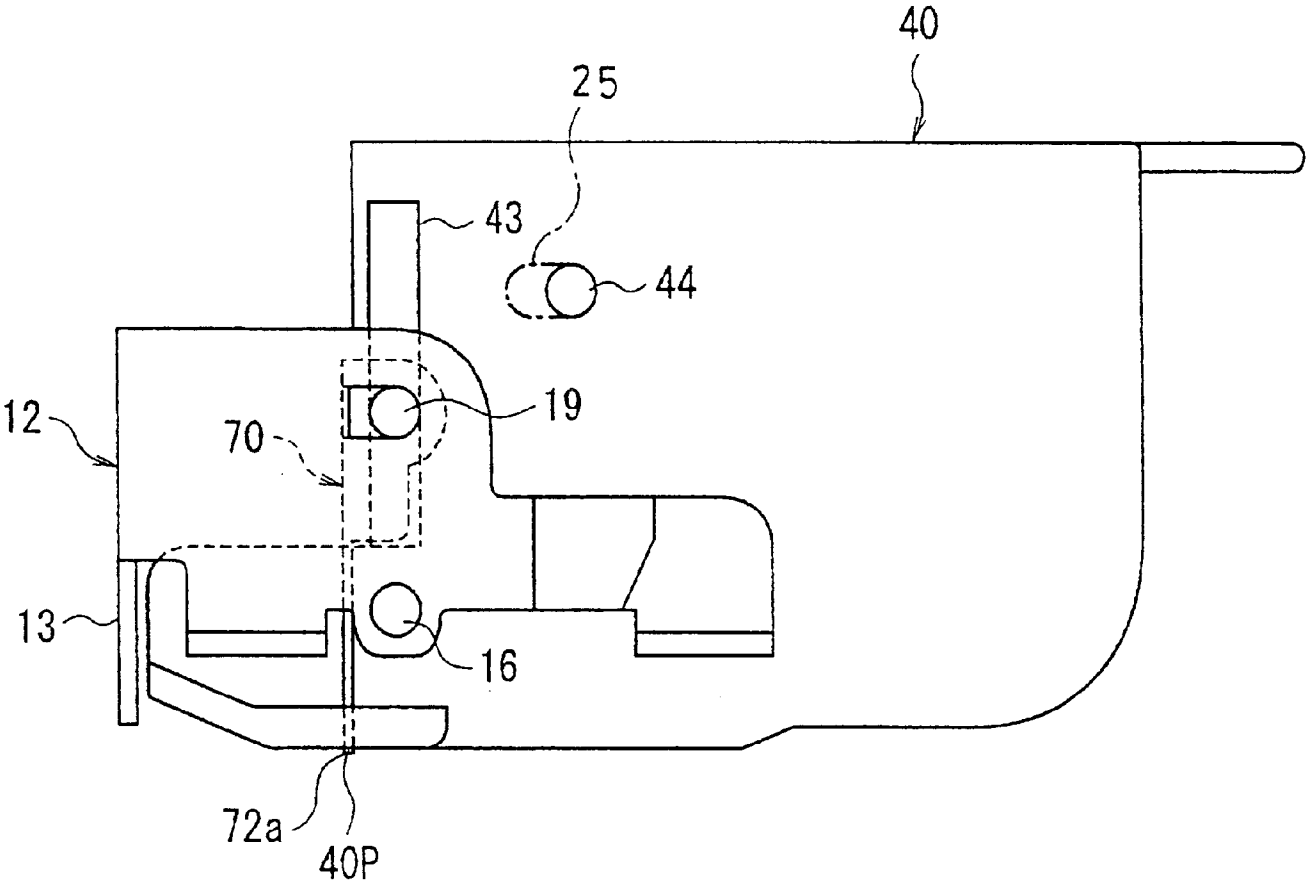
FIG. 25 is an explanatory view showing a positional relationship of the driver, magazine and fixed frame.
Figure 26:
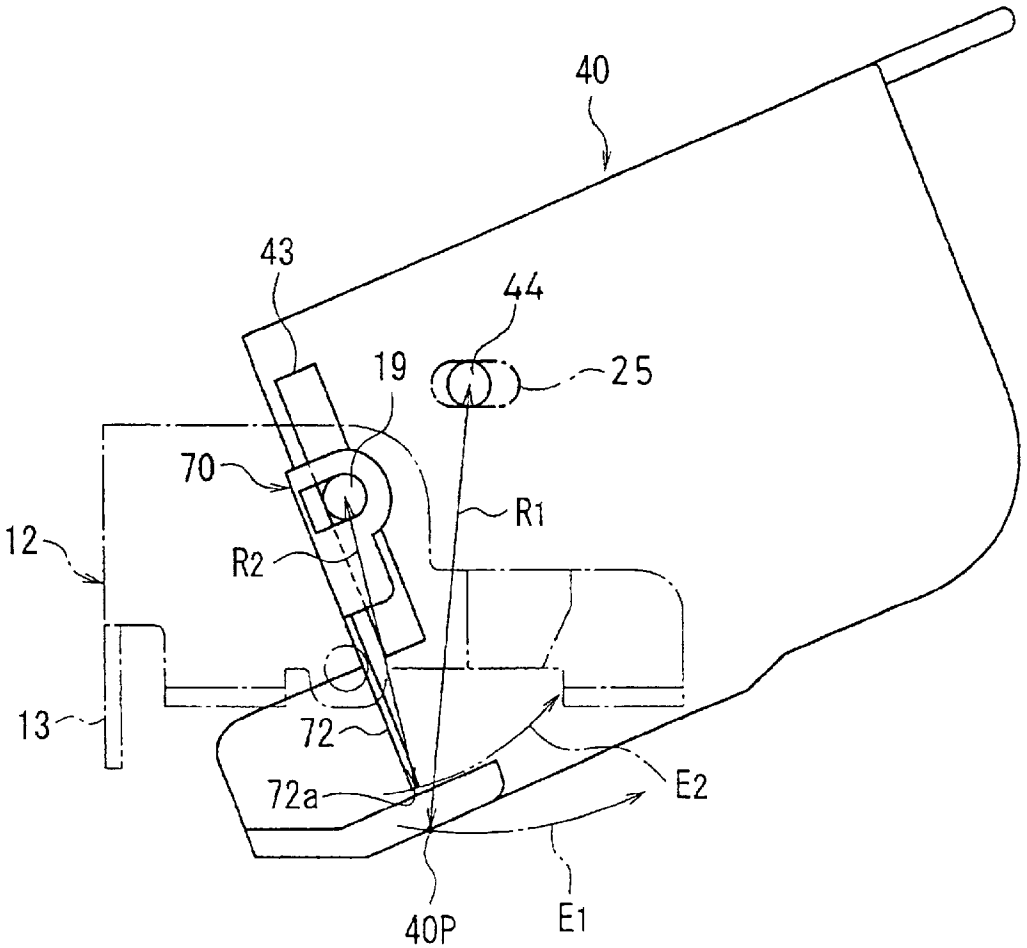
FIG. 26 is an explanatory view showing a state that the magazine is rotated.

In other words, as shown in FIG. 26, a point 40P in a bottom portion (point corresponding to the front end portions of the driver plate portions 72 in FIG. 25) of the magazine 40 moves along a circular arc E1 of a radius R1 centering on the shaft 44 in awards with the rotation of the magazine 40. On the other hand, the leading ends 72*a* of the driver plate portions 72 of the driver 70 move along a circular arc E2 of a radius R2 (R2<R1) centering on the shaft 19. In response to the rotation, a difference between the leading ends 72*a* of the driver plate portions 72 and the point 40P becomes A.

Because the shaft 19 is not moved relative to the fixed frame 12, with an object of compensating a distance between the leading ends 72*a* of the driver plate portion 72 and the point 40P, the shaft 44 of the magazine 40 begins to lower relative to fixed frame 12. When the shaft 44 is lowered relative to the fixed frame 12, the magazine 40 becomes lowered relatively to the fixed frame 12. This means that the magazine 40 is lowered relatively to the shaft 19. Consequently, the relative positional relationship between the magazine 40 and driver 70 becomes a state approaching a normal stand-by state.

In other words, the magazine 40 returns to the normal stand-by state from the lifted state relative to the driver 70, that is, the driver 70 returns to the normal stand-by state by lifting from the lowered state relative to the magazine 40. By the lifting of the driver 70, the driver plate portions 72 are removed out from between the faceplate 56 and pusher 57.

Figure 27:
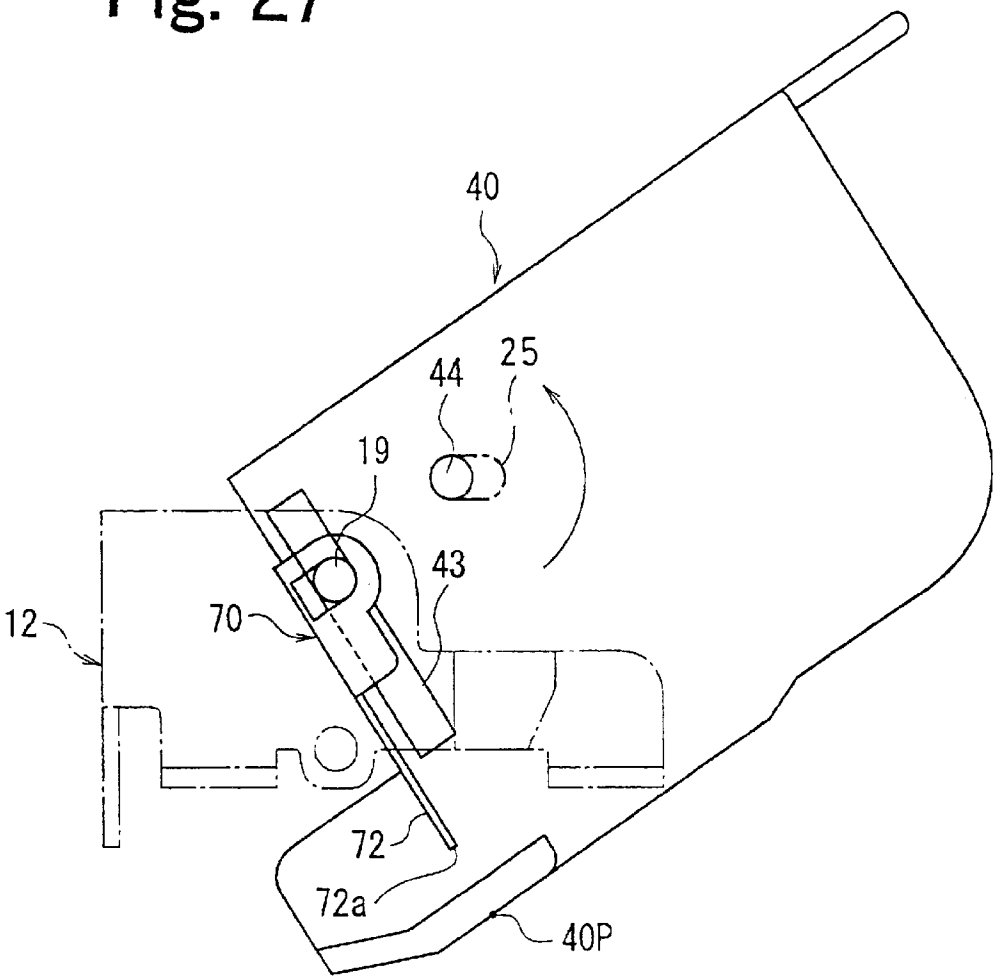
FIG. 27 is an explanatory view showing a state that the magazine shown in FIG. 26 is further rotated.
Figure 28:
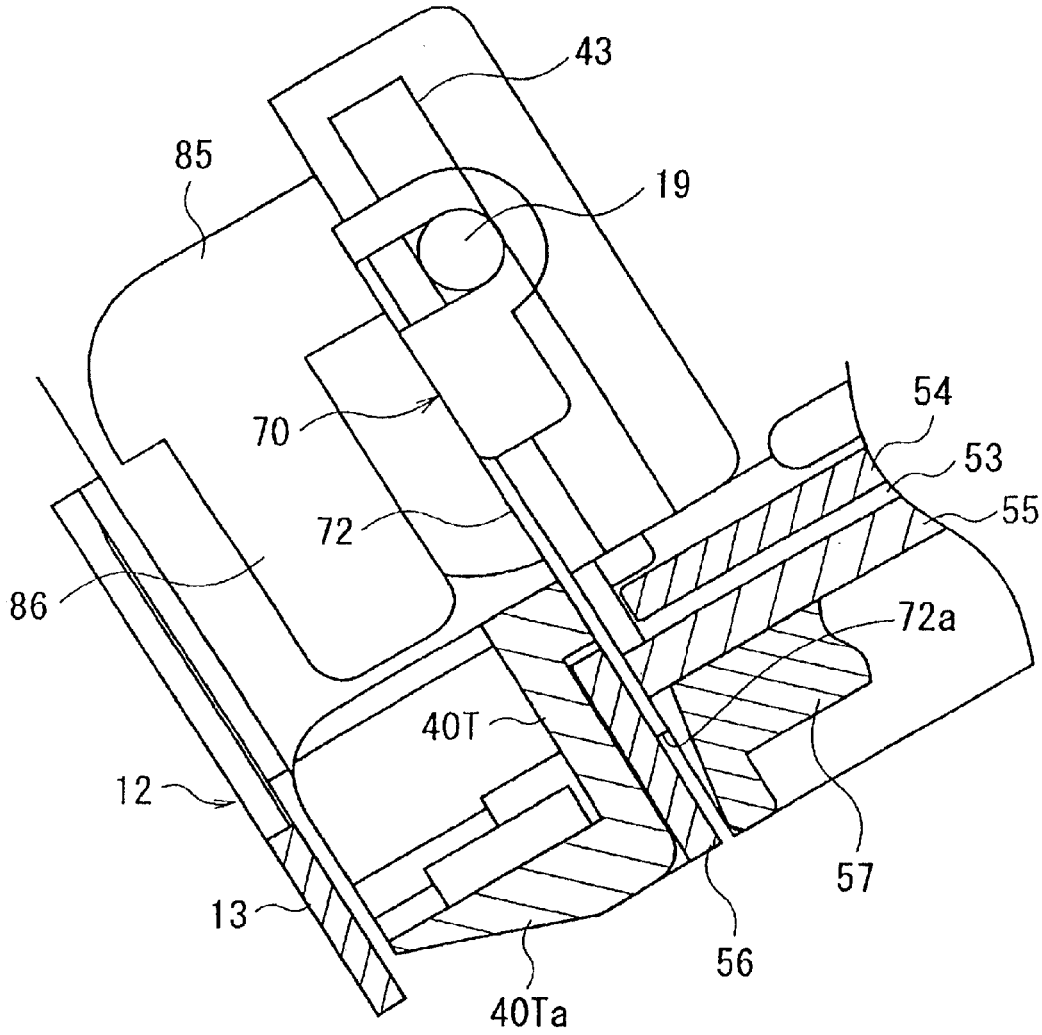
FIG. 28 is an explanatory view showing a state that driver plate portions are removed out at the time the magazine is rotated.

When the magazine 40 is stated to the position shown in FIG. 27, in other words, if the magazine 40 is rotated about 32 degrees relative to fixed frame 12, the driver plate portions 72 are removed from between the faceplate 56 and pusher 57 to the position shown in FIG. 28. When the driver plate portions 72 come to the position, by the jamming, a frictional force applied to the driver plate portions 72 becomes almost zero, and the driver 70 is lifted relative to the magazine 40 by the spring 89 and therefore the driver plate portions 72 of the driver 70 are removed out completely from between the faceplate 56 and pusher 57. If the driver plate portions 72 are removed out completely from between the faceplate 56 and pusher 57, the staple jammed between the faceplate 56 and pusher 57 may be removed by removing the cartridge 50 of the magazine 40, and then by rotating the faceplate 56 of the cartridge 50 about the shaft 59 counterclockwise.

In this way, even if the jamming is generated, by rotating the magazine 40, the driver plate portions 72 can be removed from between the faceplate 56 and pusher 57 to remove the cartridge 50 from the magazine 40.

[Second Mode for Carrying Out]

Figure 29:
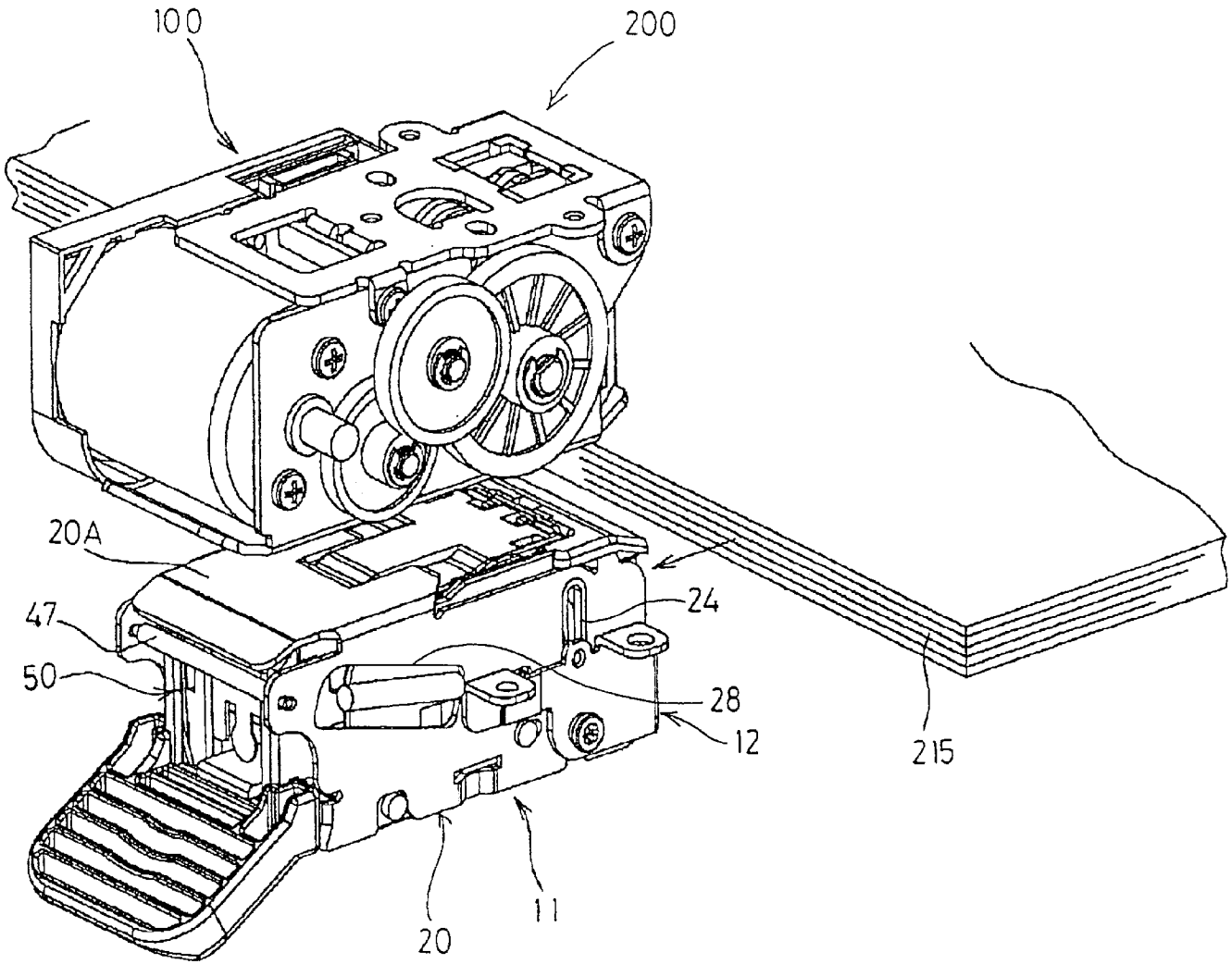
FIG. 29 is a perspective view showing an electric stapler in a second mode.

FIG. 29 illustrates an electric stapler 200 for saddle stitching a magazine or the like. The electric stapler 200 comprises two driver units 11 and two clincher units 100 disposed above the driver units 11(see FIG. 31).

Figure 30:
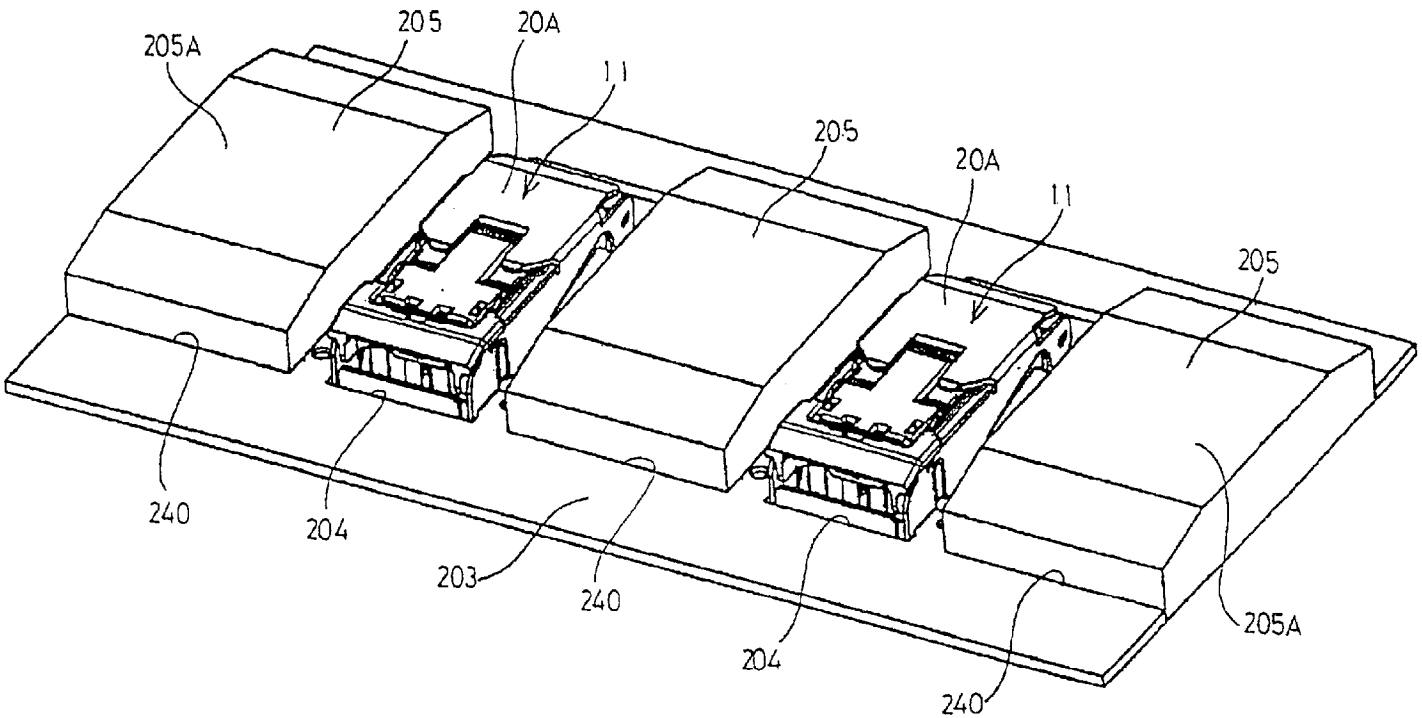
FIG. 30 is a perspective view showing a state that a clincher unit and sheet receivers are attached to a base plate.

The driver units 11 are disposed in a pair of openings 204 provided in a base plate 203, respectively, as shown in FIG. 30. A fixed frame 12 of each of the drive units 11 is attached within the a corresponding opening 204 and an inner frame 20 of each driver unit 11 is movable upwardly and downwardly in the opening 204.

Sheet or paper receivers (sheet reference bodies) 205 are disposed movably upwardly and downwardly at three openings 240 provided in the base plate 203, respectively. The openings 204 and 240 are alternately arranged.

Figure 31:
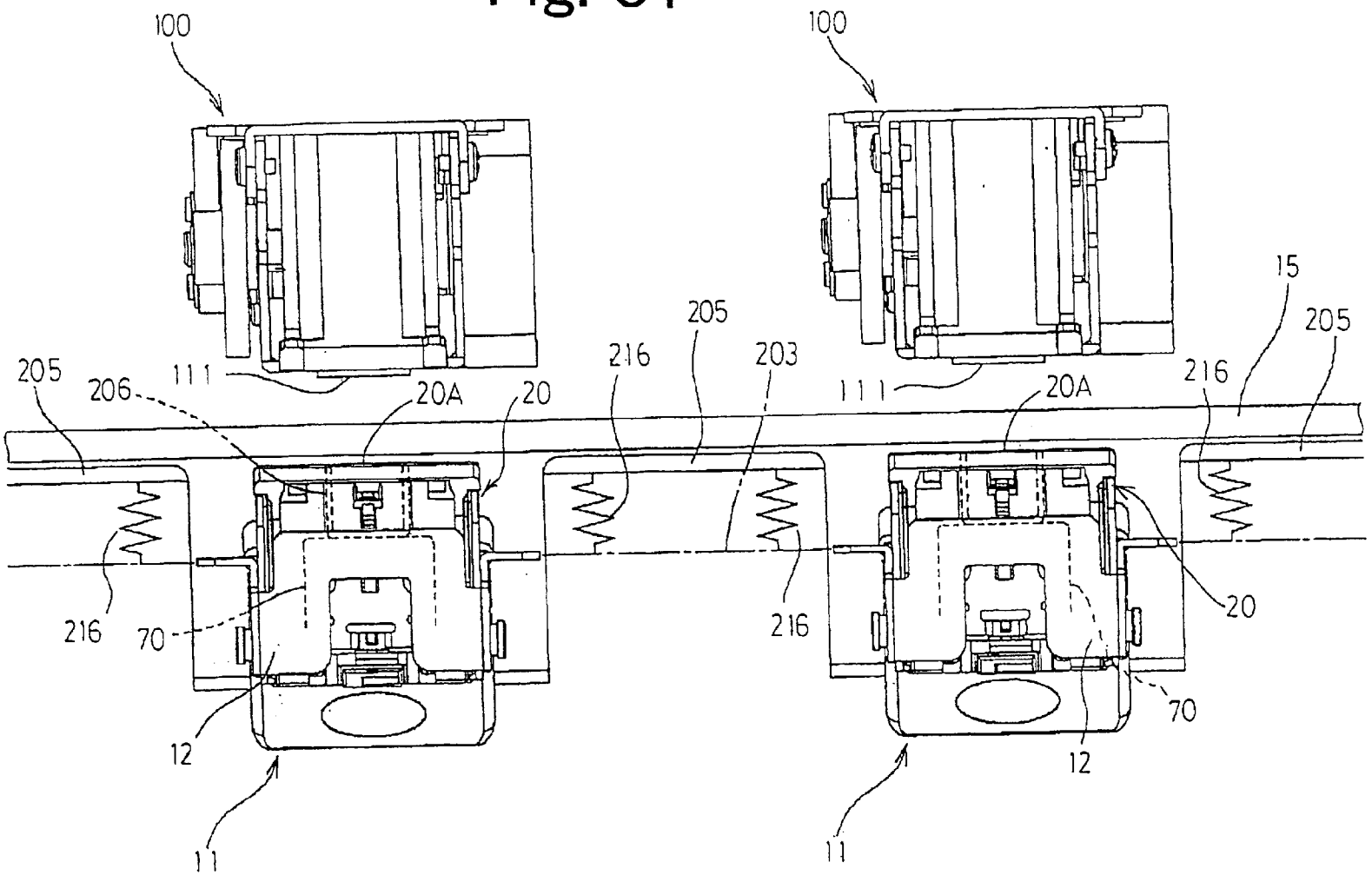
FIG. 31 is an explanatory view showing a structure of the electric stapler in the second mode.
Figure 32:
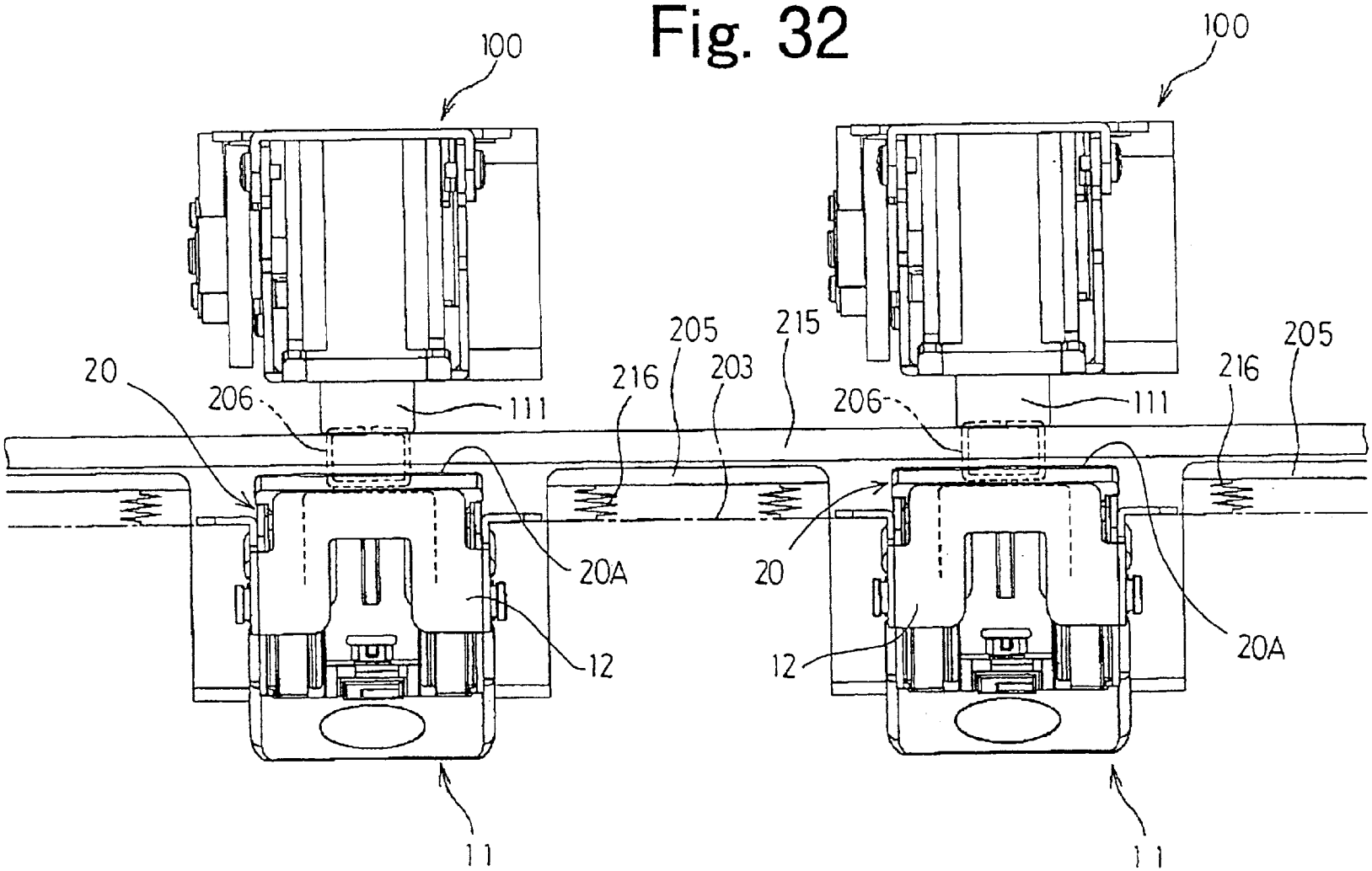
FIG. 32 is an explanatory view showing a stapling operation of the electric stapler in the second mode.
Figure 33:
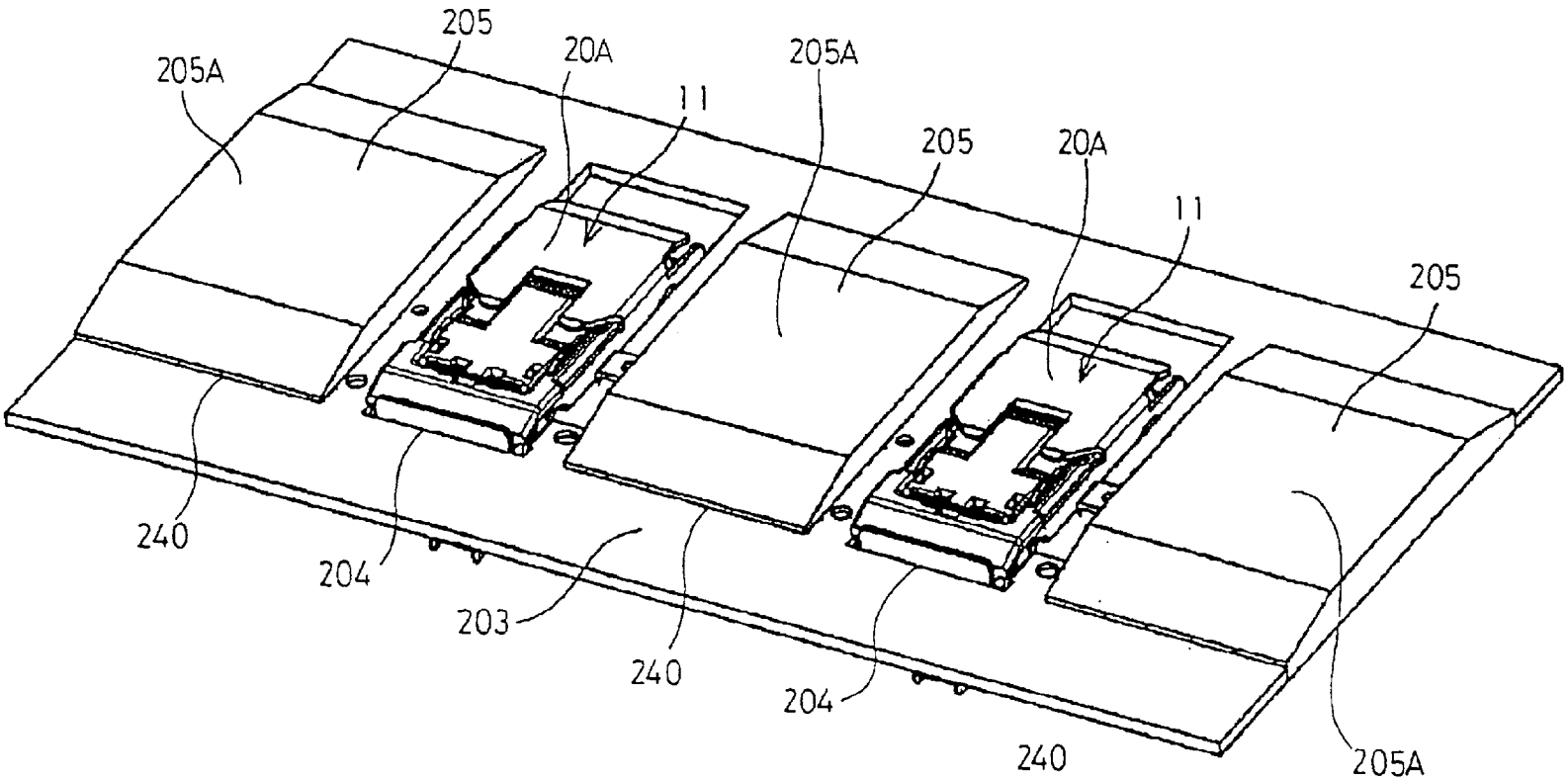
FIG. 33 is a perspective view showing a state that the sheet receivers mounted on the base plate are moved downwardly.
Figure 34A:
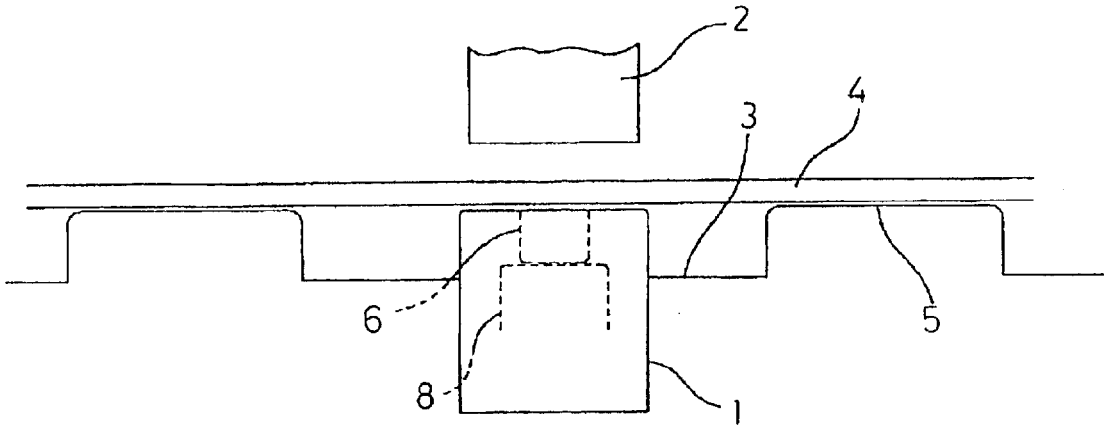
Fig. 34A Prior Art
FIG. 34A is an explanatory view showing a conventional electric stapler.
Figure 34B:
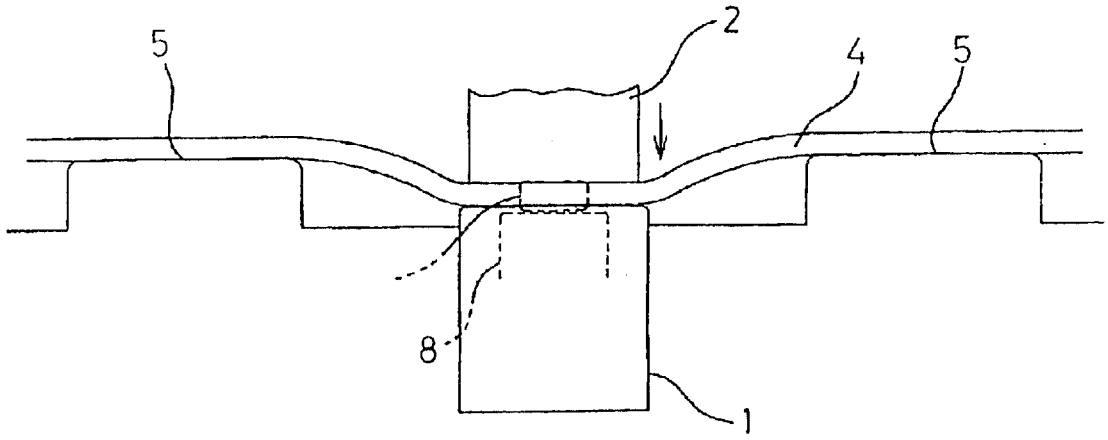
Fig. 34B Prior Art
FIG. 34B is an explanatory view showing a problem of the conventional electric stapler.

The sheet receivers 205 are biased upwardly by the springs 216 as shown in FIG. 31. Each of the sheet receivers is limited by a limiting member, which is not shown, not to move upwardly from a position shown in FIG. 31 so that an upper surface 205A of each sheet receiver 205 and an upper surface 20A of each driver unit 11 are substantially flush.

Each of the sheet receivers 205 is connected with the inner frame 20 of each driver unit 11 to move upwardly and downwardly with the inner frame.

[Operation]

Nest, an operation of the second mode as described above will be explained.

As shown FIG. 29, papers 215 are disposed between the driver units 11 and clincher units 100. When the papers 215 are disposed between the upper surface of each drive unit 11 and the upper space 205A of each sheet receiver 205, a clincher part 111 of each clincher unit 100 is lowered to hold the papers 215 with the upper surface 20A of each of the driver units 11. If the clincher part 111 is further lowered, the inner frame 20 of each driver unit 11 is pressed downwardly through the papers 215. With the movement downwardly of the inner frame 20, a staple 206 is driven out by means of the driver 70, similarly as in the first mode.

In addition, when each of the inner frame 20 is moved downwardly, the papers 215 are also pressed by the clincher parts 111 to move downwardly, while, the sheet receiver 205 are moved downwardly with the inner frames 20 against the springs 216 and therefore the papers 215 are not driven in lower positions between the sheet receivers 205. Therefore, the papers 215 are held in a flat condition and the staple 206 is driven in the flat papers. Consequently, there are no problems that an improper stapling is generated and misaligned papers are stapled and so on.

When the stapling is completed, the clincher part 111 of each of the clincher units 100 is lifted and then the papers 215 are transported to a predetermined position. When each clincher part 111 is lifted, the inner frames 20 and sheet receivers 205 are returned to an initial position by the biasing force of the 216, as shown in FIG. 30.

EFFECT OF THE INVENTION

As described above, the present invention maker it possible to the cartridge firm the magazine even if the jamming is generated. It is also possible to avoid the generation of improper stapling and the stapling of misaligned papers.

What is claimed is:

1. A driver unit, comprising:

a movable frame attached movably upwardly and downwardly to a fixed frame;

a magazine attached to the movable frame for moving upwardly and downwardly together with the movable frame;

a cartridge which is attached attachably and detachably on the magazine and which contains sheet staples and which has a drive-out part for driving-out each of the sheet staples at a leading end thereof;

a driver which is attached in a front of the magazine and which is moved upwardly and downwardly relative to the magazine and which is mounted pivotally through an elongated hole of the movable frame on the fixed frame; and a biasing member for biasing the magazine in one of up and down directions and the driver relative to the magazine in the other of the up and down directions, said driver being entered relatively into said drive-out part by movement of the movable frame relative to the fixed frame against a biased force of the biasing member in accordance with movement of a moving means of a clincher unit toward the magazine in order to drive-out the staple, when the moving means of the clincher unit is moved apart away from the magazine, the movable frame and magazine being moved by the biasing member to be returned to an initial position, wherein said magazine is mounted pivotally on the movable frame at a position apart from the drive-out part than the mounted position of the driver to be rotatable the magazine about its pivot relative to the movable frame.

2. An electric stapler comprising the driver unit as recited in claim 1.

3. The electric stapler according to claim 2, wherein said driver unit is disposed upwardly and said clincher unit is disposed below the driver unit.

4. The electric stapler according to claim 2, wherein said driver unit is disposed downwardly, and the clincher unit is disposed upwardly of the driver unit, and wherein sheet receivers are positioned on the opposite sides of the driver unit to become flush with an upper surface of the driver unit, the sheet receivers being lowered together with the lowering of the driver unit.

5. The electric stapler according to claim 4, further comprising plural pairs of drivers and clincher units.

* * * * *